US011004403B2

(12) United States Patent
Park

(10) Patent No.: US 11,004,403 B2
(45) Date of Patent: May 11, 2021

(54) DISPLAY DEVICE AND METHOD OF DRIVING THE SAME

(71) Applicant: LG Display Co., Ltd., Seoul (KR)

(72) Inventor: Joon-Min Park, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/684,131

(22) Filed: Nov. 14, 2019

(65) Prior Publication Data

US 2020/0160794 A1 May 21, 2020

(30) Foreign Application Priority Data

Nov. 20, 2018 (KR) ..... 10-2018-0143680

(51) Int. Cl.
*G09G 3/3291* (2016.01)

(52) U.S. Cl.
CPC ... *G09G 3/3291* (2013.01); *G09G 2300/0842* (2013.01); *G09G 2310/027* (2013.01)

(58) Field of Classification Search
CPC ..... G09G 3/3291; G09G 3/3233
See application file for complete search history.

(56) References Cited

U.S. PATENT DOCUMENTS

| | | | | |
|---|---|---|---|---|
| 10,748,480 | B2 * | 8/2020 | Zeng | G09G 3/3233 |
| 2016/0189630 | A1 | 6/2016 | Chang et al. | |
| 2018/0061296 | A1 * | 3/2018 | Shim | G09G 3/3233 |
| 2018/0144705 | A1 | 5/2018 | Lee et al. | |
| 2019/0325822 | A1 * | 10/2019 | Li | G09G 3/3266 |

FOREIGN PATENT DOCUMENTS

| | | | |
|---|---|---|---|
| EP | 3640926 | A1 | 4/2020 |
| JP | 2015-222327 | A | 12/2015 |

* cited by examiner

*Primary Examiner* — Sardis F Azongha
(74) *Attorney, Agent, or Firm* — Seed IP Law Group LLP

(57) ABSTRACT

A display device and a method of driving the same. Characteristics of driving transistors disposed in subpixels of a display panel are sensed and compensated for, thereby improving the image quality of the organic light-emitting display device. Changes in a data voltage between a point in time at which a blank period starts and a period in which the sensing of the driving transistors starts are reduced or minimized, thereby reducing deviations in the sensing of the characteristics of the driving transistors.

19 Claims, 17 Drawing Sheets

$\Delta Tbs = Tbs/n$ $$(Vdata2 - Vdata1)/n = K * Vdata(s)$$
$$\Delta V1 = \Delta V2 = \cdots = \Delta Vn = (Vdata2 - Vdata1)/n$$

$$(Vdata2 - Vdata1)/n \neq K * Vdata(s)$$
$$\Delta V1 < \Delta V2 = \cdots = \Delta Vn$$
$$\Delta V1 = a * Vdata(s)$$
$$\Delta V2 = \cdots = \Delta Vn = b * Vdata(s)$$
$$a < b$$

$$(Vdata2 - Vdata1)/n \neq K * Vdata(s)$$
$$\Delta V1 = \cdots = \Delta Vn-1 > \Delta Vn$$
$$\Delta V1 = \cdots = \Delta Vn-1 = a * Vdata(s)$$
$$\Delta Vn = b * Vdata(s)$$
$$a > b$$

$Vdata2 - Vdata1 <= Vdata(s)$
$\Delta V1 = Vdata2 - Vdata1$

DISPLAY DEVICE AND METHOD OF DRIVING THE SAME

CROSS REFERENCE TO RELATED APPLICATION

This application claims priority to Korean Patent Application No. 10-2018-0143680, filed on Nov. 20, 2018, which is hereby incorporated by reference for all purposes as if fully set forth herein.

BACKGROUND

Technical Field

The present disclosure relates to a display device and a method of driving the same.

Description of the Related Art

With the development of the information society, there has been an increasing demand for a variety of types of image display devices. In this regard, a range of display devices, such as liquid crystal display (LCD) devices, plasma display devices, and organic light-emitting diode (OLED) display devices, have recently come into widespread use.

Among such display devices, organic light-emitting display devices have superior properties, such as rapid response speeds, high contrast ratios, high emissive efficiency, high luminance, and wide viewing angles, since self-emissive organic light-emitting diodes (OLEDs) are used.

Such an organic light-emitting display device may include organic light-emitting diodes disposed in a plurality of subpixels SP arrayed in a display panel, and may control the organic light-emitting diodes to emit light by controlling a voltage flowing through the organic light-emitting diodes, so as to display an image while controlling luminance of the subpixels.

In this case, in such an organic light-emitting display device, an organic light-emitting diode (OLED) and a driving transistor to drive organic light-emitting diode (OLED) are disposed in each subpixel SP defined in the display panel. At this time, there may be deviations in the characteristics of transistors in each subpixel SP, such as threshold voltage or mobility, due to changes over the driving time or different driving times among the subpixels SP. Accordingly, luminance deviations (or luminance non-uniformity) may occur among the subpixels SP, thereby degrading image quality.

BRIEF SUMMARY

Solutions for sensing deviations in the characteristics of driving transistors and compensating for such deviations have been proposed in order to remove luminance deviations among the subpixels SP of the organic light-emitting display device. However, despite such solutions for sensing and compensating, display images may have failure due to sensing errors occurring for unexpected reasons.

In particular, in a case in which the sensing of the characteristics of the driving transistors is performed in real time during image driving, the sensing may be referred to as a real-time (RT) sensing process. The RT sensing process may be performed on one or more subpixels SP in one or more subpixel lines in every blank period during an image driving period.

In this case, due to changes in the data voltage in a period between a point in time at which a blank period starts and a point in time at which the sensing of the driving transistors starts, sensing deviations may occur among the characteristics of driving transistors, which is problematic.

Various aspects of the present disclosure provide a display device and a method of driving the same, able to sense characteristics of driving transistors disposed in subpixels of a display panel and compensate for deterioration.

Also provided are a display device and a method of driving the same, able to reduce or minimize changes in a data voltage between a start point of a blank period and a start point of a sensing period of the driving transistors, thereby reducing deviations in the sensing of the characteristics of the driving transistors.

Various embodiments of the present disclosure provide a display device and a method of driving a display device according to the independent claims. Further embodiments are described in the dependent claims. According to an aspect of the present disclosure, a display device may include: a display panel including a plurality of gate lines, a plurality of data lines, and a plurality of subpixels; a gate driver circuit driving the plurality of gate lines; a data driver circuit driving the plurality of data lines; and a timing controller, which includes a memory storing a data voltage-for-sensing to sense a characteristic of a circuit element, controlling signals applied to the gate driver circuit and the data driver circuit, wherein the timing controller controls the data driver circuit to gradually change a data voltage from a start point of a blank period to a start point of a sensing period.

The data voltage at the start point of the blank period may correspond to a data voltage-for-driving image applied in an emission period of the display panel at a point in time before the blank period starts.

The data voltage at the start point of the sensing period may correspond to the data voltage-for-sensing to be applied to the display panel after the gradual change to the data voltage is completed.

A rising slope of the data voltage may be calculated using a voltage difference between the data voltage at the start point of the blank period and the data voltage at the start point of the sensing period and a time difference between the start point of the blank period and the start point of the sensing period, and the data voltage may be gradually changed using the rising slope.

Each of the plurality of subpixels may include: an organic light-emitting diode; a driving transistor driving the organic light-emitting diode; a switching transistor electrically connected between a gate node of the driving transistor and a data line among the plurality of data lines; a sensing transistor electrically connected between a source node or a drain node of the driving transistor and a reference voltage line; and a storage capacitor electrically connected between a gate node and a source node or a drain node of the switching transistor.

A process of sensing a characteristic of the organic light-emitting diode or the driving transistor may be performed in the sensing period.

The process of sensing the characteristic of the driving transistor may include: an initialization period in which the data voltage-for-sensing is supplied through the data line, and a reference voltage-for-sensing is supplied through the reference voltage line in a state the switching transistor is turned on; a tracking period in which a voltage of the reference voltage line is increased in response to the reference voltage-for-sensing being blocked; and a sampling period in which the characteristic of the driving transistor is sensed through the reference voltage line.

The display device may further include a compensation circuit determining a compensation value for the image data voltage using a sensed value of the characteristic of the driving transistor and applying a corrected image data voltage according to the determined compensation value, to a corresponding subpixel among the plurality of subpixels.

The compensation circuit may include: an analog-to-digital converter measuring a voltage of a reference voltage line electrically connected to the driving transistor and converting the measured voltage into a digital value; a switch circuit electrically connected between the driving transistor and the analog-to-digital converter to control an operation of sensing the characteristic of the driving transistor; a memory storing the sensed value supplied from the analog-to-digital converter or retaining a reference sensing value previously stored therein; a compensator comparing the sensed value with the reference sensing value stored in the memory to determine the compensation value, by which a characteristic deviation of the driving transistor is compensated for; a digital-to-analog converter converting the image data voltage, changed according to the compensation value determined by the compensator, into an analog image data voltage; and a buffer outputting the analog image data voltage supplied from the digital-to-analog converter, to a data line designated from among the plurality of data lines.

The controlling of the data driver circuit to gradually change the data voltage may include: dividing a time difference between the start point of the blank period and the start point of the sensing period into n number of time periods; dividing a voltage difference between the data voltage at the start point of the blank period and the data voltage at the start point of the sensing period into n number of data voltage change sizes; and controlling the data voltage to gradually change during at least one time period among the n number of time periods in a period between the start point of the blank period and the start point of the sensing period.

The n number of time periods is determined by the number of a divided data enable signal applied between the start point of the blank period and the start point of the sensing period.

If a value obtained by dividing a voltage difference between the data voltage at the start point of the blank period and the data voltage at the start point of the sensing period with the n number of time periods is a multiple of a resolution of the data voltage, the timing controller controls the data voltage to be changed by a constant size during the n number of time periods in a period between the start point of the blank period and the start point of the sensing period.

If a value obtained by dividing a voltage difference between the data voltage at the start point of the blank period and the data voltage at the start point of the sensing period with the n number of time periods is not a multiple of a resolution of the data voltage, the timing controller controls the data voltage to be changed by an asymmetrical size during one or more time periods among the n number of time periods in a period between the start point of the blank period and the start point of the sensing period.

If a voltage difference between the data voltage at the start point of the blank period and the data voltage at the start point of the sensing period is equal to or smaller than a resolution of the data voltage, the timing controller controls the data voltage to be changed by a size corresponding to the voltage difference between the data voltage at the start point of the blank period and the data voltage at the start point of the sensing period at the start point of the blank period or the start point of the sensing period.

According to another aspect, provided is a method of driving a display device including a display panel comprised of a plurality of data lines and a plurality of gate lines, a plurality of subpixels aligned in intersected areas of the data lines and the gate lines to light organic light-emitting diodes via driving transistors, and a plurality of reference voltage lines, a data driver circuit driving the plurality of data lines, a gate driver circuit driving the plurality of gate lines, and a timing controller comprising a memory storing a data voltage-for-sensing to sense a characteristic of a circuit element, and controlling signals applied to the gate driver circuit and the data driver circuit, the method comprising: applying a data voltage to be gradually changed according to a rising slope from a start point of a blank period to a start point of a sensing period by using a data voltage-for-driving image applied to an emission period, as an initial level.

The method may further include: calculating a voltage difference between the data voltage-for-driving image applied to the display panel at the start point of the blank period and the data voltage-for-sensing to be applied to the display panel at the start point of the sensing period; calculating a time difference between the start point of the blank period and the start point of the sensing period; and calculating the rising slope of the data voltage by dividing the voltage difference with the time difference, wherein the data voltage changes according to the rising slope of the data voltage.

The step of applying the data voltage to gradually change may include: dividing the time difference between the start point of the blank period and the start point of the sensing period into n number of time periods; dividing the voltage difference between the data voltage at the start point of the blank period and the data voltage at the start point of the sensing period into n number of data voltage change sizes; and controlling the data voltage to be gradually changed during at least one time period among the n number of time periods in a period between the start point of the blank period and the start point of the sensing period.

Then number of time periods is determined by the number of a divided data enable signal applied between the start point of the blank period and the start point of the sensing period.

If a value obtained by dividing a voltage difference between the data voltage at the start point of the blank period and the data voltage at the start point of the sensing period with the n number of time periods is a multiple of a resolution of the data voltage, the timing controller controls the data voltage to be changed by a constant size during the n number of time periods in a period between the start point of the blank period and the start point of the sensing period.

If a value obtained by dividing a voltage difference between the data voltage at the start point of the blank period and the data voltage at the start point of the sensing period with the n number of time periods is not a multiple of a resolution of the data voltage, the timing controller controls the data voltage to be changed by an asymmetrical size during one or more time periods among the n number of time periods in a period between the start point of the blank period and the start point of the sensing period.

If a voltage difference between the data voltage at the start point of the blank period and the data voltage at the start point of the sensing period is equal to or smaller than a resolution of the data voltage, the timing controller controls the data voltage to be changed by a size corresponding to the voltage difference between the data voltage at the start point of the blank period and the data voltage at the start point of the sensing period at the start point of the blank period or the start point of the sensing period.

According to one or more embodiments, it is possible to sense characteristics of driving transistors disposed in subpixels of a display panel and perform compensation, thereby improving the image quality of the organic light-emitting display device.

According to one or more embodiments, it is possible to reduce or minimize changes in a data voltage between a point in time at which a blank period starts and a period in which the sensing of the driving transistors starts, thereby reducing deviations in the sensing of the characteristics of the driving transistors.

DESCRIPTION OF THE SEVERAL VIEWS OF THE DRAWINGS

The above and other objects, features, and advantages of the present disclosure will be more clearly understood from the following detailed description, taken in conjunction with the accompanying drawings, in which.

DETAILED DESCRIPTION

Figure 1:
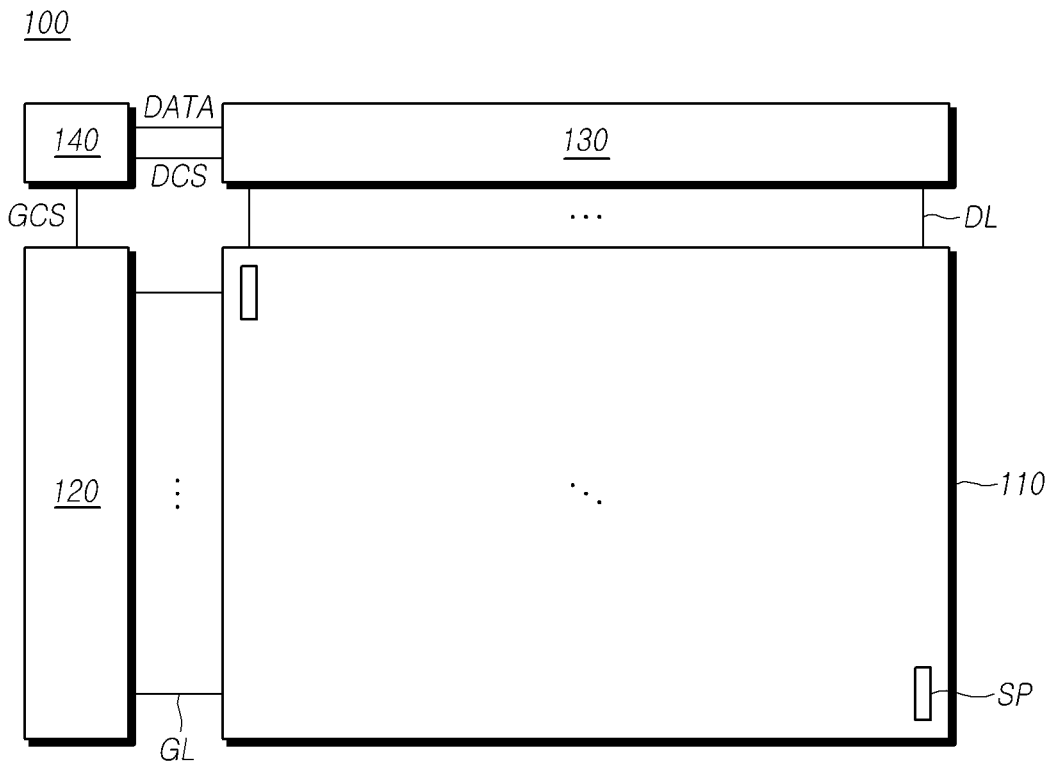
FIG. 1 illustrates a schematic configuration of a display device according to one or more embodiments.

The advantages and features of the present disclosure and methods of the realization thereof will be apparent with reference to the accompanying drawings and detailed descriptions of the embodiments. The present disclosure should not be construed as being limited to the embodiments set forth herein and may be embodied in many different forms. Rather, these embodiments are provided so that the present disclosure will be thorough and complete, and will fully convey the scope of the present disclosure to a person having ordinary skill in the art.

The shapes, sizes, ratios, angles, numbers, and the like, inscribed in the drawings to illustrate various embodiments are illustrative only, and the present disclosure is not limited to the embodiments illustrated in the drawings. Throughout this document, the same reference numerals and symbols will be used to designate the same or like components. In the following description of the present disclosure, detailed descriptions of known functions and components incorporated into the present disclosure will be omitted in the case that the subject matter of the present disclosure may be rendered unclear thereby. It will be understood that the terms "comprise," "include," "have," and any variations thereof used herein are intended to cover non-exclusive inclusions unless explicitly described to the contrary. Descriptions of components in the singular form used herein are intended to include descriptions of components in the plural form, unless explicitly described to the contrary.

In the analysis of components according to various embodiments, it shall be understood that an error range is included therein, even in the case in which there is no explicit description thereof.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected," "coupled," or "linked" to another element, not only can it be "directly connected, coupled, or linked" to the other element, but it can also be "indirectly connected, coupled, or linked" to the other element via an "intervening" element. In the same context, it will be understood that when an element is referred to as being formed "on" or "under" another element, not only can it be directly located on or under the other element, but it can also be indirectly located on or under the other element via an intervening element.

In addition, terms, such as "first" and "second" may be used herein to describe a variety of components. It should be understood, however, that these components are not limited by these terms. These terms are merely used to discriminate one element or component from other elements or components. Thus, a first element referred to as first hereinafter may be a second element within the spirit of the present disclosure.

The features of one or more embodiments of the present disclosure may be partially or entirely coupled or combined with each other and may work in concert with each other or may operate in a variety of technical methods. In addition, respective one or more embodiments may be carried out independently or may be associated with and carried out in concert with other embodiments.

Hereinafter, one or more embodiments will be described in detail with reference to the drawings.

FIG. 1 illustrates a schematic configuration of a display device according to one or more embodiments.

Referring to FIG. 1, the display device 100 according to one or more embodiments may include a display panel 110 in which a plurality of subpixels SP are arrayed in rows and columns, a gate driver circuit 120 and a data driver circuit 130 driving the display panel 110, and a timing controller 140 controlling the gate driver circuit 120 and the data driver circuit 130.

In the display panel 110, a plurality of gate lines GL and a plurality of data lines DL are disposed, and a plurality of subpixels SP are arrayed in adjacent areas in which the plurality of gate lines GL overlap the plurality of data lines DL. For example, in an organic light-emitting display device having a resolution of 2,160×3,840, that is, 2,160 gate lines GL and 3,840 data lines DL may be provided, and plurality of subpixels SP may be arrayed in adjacent areas in which the plurality of gate lines GL overlap the plurality of data lines DL.

The gate driver circuit 120 is controlled by the timing controller 140, and controls the driving timing of the plurality of subpixels SP by sequentially outputting a scan signal SCAN to the plurality of gate lines GL disposed in the display panel 110. In the organic light-emitting display device 100 having a resolution of 2,160×3,840, sequential output of the scan signal to the 2,160 gate lines GL from the first gate line GL1 to the 2,160th gate line GL may be referred to as 2,160 phase driving. In addition, a case in which the scan signal is output sequentially to every four gate lines, as in a case in which the scan signal is output sequentially to four gate lines, such as first to fourth gate lines GL1 to GL4, and then is output sequentially to next four gate lines, such as fifth to eighth gate lines GL5 to GL8, is referred to as 4 phase driving. As described above, a case in which the scan signal is output sequentially to every N number of gate lines may be referred as N-phase driving.

The gate driver circuit 120 may include one or more gate driver integrated circuits (GDIC), which may be disposed on one side or both sides of the display panel 110 depending on the driving system. Alternatively, the gate driver circuit 120 may be implemented using a gate-in-panel (GIP) structure embedded in a bezel area of the display panel 110.

In addition, the data driver circuit 130 receives image data from the timing controller 140, and converts the received image data into an analog data voltage Vdata. Afterwards, the data driver circuit 130 outputs the data voltage Vdata to each of the data lines DL at points in time at which the scan signal is applied through the gate lines GL, so that each of the subpixels SP connected to the data lines DL are lit at a corresponding luminous intensity in response to the data voltage Vdata.

Likewise, the data driver circuit 130 may include one or more source driver ICs (SDICs). Each of the source driver ICs may be connected to a bonding pad of the display panel 110 by a tape-automated bonding (TAB) method or a chip-on-glass (COG) method, or may be directly mounted on the display panel 110. In some cases, each of the source driver ICs may be integrated with the display panel 110. In addition, each of the source driver ICs may be implemented using a chip-on-film (COF) structure. In this case, the source driver ICs may be mounted on circuit films to be electrically connected to the data lines DL in the display panel 110 via the circuit films.

The timing controller 140 supplies a variety of control signals to the gate driver circuit 120 and the data driver circuit 130, and controls the operations of the gate driver circuit 120 and the data driver circuit 130. That is, the timing controller 140 controls the gate driver circuit 120 to output the scan signal at points in time realized by respective frames, and on the other hand, converts data input from an external source into image data having a data signal format readable by the data driver circuit 130 and outputs the converted image data to the data driver circuit 130.

Here, the timing controller 140 receives a variety of timing signals, including a vertical synchronization signal Vsync, a horizontal synchronization signal Hsync, a data enable (DE) signal, a clock (CLK) signal, and the like, from an external source (e.g., a host system). Accordingly, the timing controller 140 generates a variety of control signals using the variety of timing signals received from the external source, and outputs the variety of control signals to the gate driver circuit 120 and the data driver circuit 130.

For example, the timing controller 140 outputs a variety of gate control signals GCS, including a gate start pulse (GSP) signal, a gate shift clock (GSC) signal, a gate output enable (GOE) signal, and the like, to control the gate driver circuit 120. Here, the gate start pulse signal is used to control the operation start timing of one or more gate driver ICs of the gate driver circuit 120. In addition, the gate shift clock signal is a clock signal commonly input to the one or more gate driver ICs to control the shift timing of the scan signal. The gate output enable signal designates timing information of the one or more gate driver ICs.

In addition, the timing controller 140 outputs a variety of data control signals DCS, including a source start pulse (SSP) signal, a source sampling clock (SSC) signal, a source output enable (SOE) signal, and the like, to control the data driver circuit 130. Here, the source start pulse signal is used to control the data sampling start timing of one or more source driver ICs of the data driver circuit 130. The source sampling clock signal is a clock signal controlling the sampling timing of data in each of the source driver ICs. The source output enable signal controls the output timing of the data driver circuit 130.

The display device 100 may further include a power management IC (PMIC) supplying various forms of voltage or current to the display panel 110, the gate driver circuit 120, the data driver circuit 130, and the like, or controls various forms of voltage or current to be supplied to the same.

The subpixels SP are located adjacent to points at which the gate lines GL overlap the data lines DL, and a light-emitting element may be disposed in each of the subpixels SP. For example, the display device 100 includes a light-emitting element, such as a light-emitting diode (LED) or an organic light-emitting diode (OLED) in each of the subpixels SP, and may display an image by controlling current flowing through the light-emitting elements in response to the data voltage Vdata.

Figure 2:
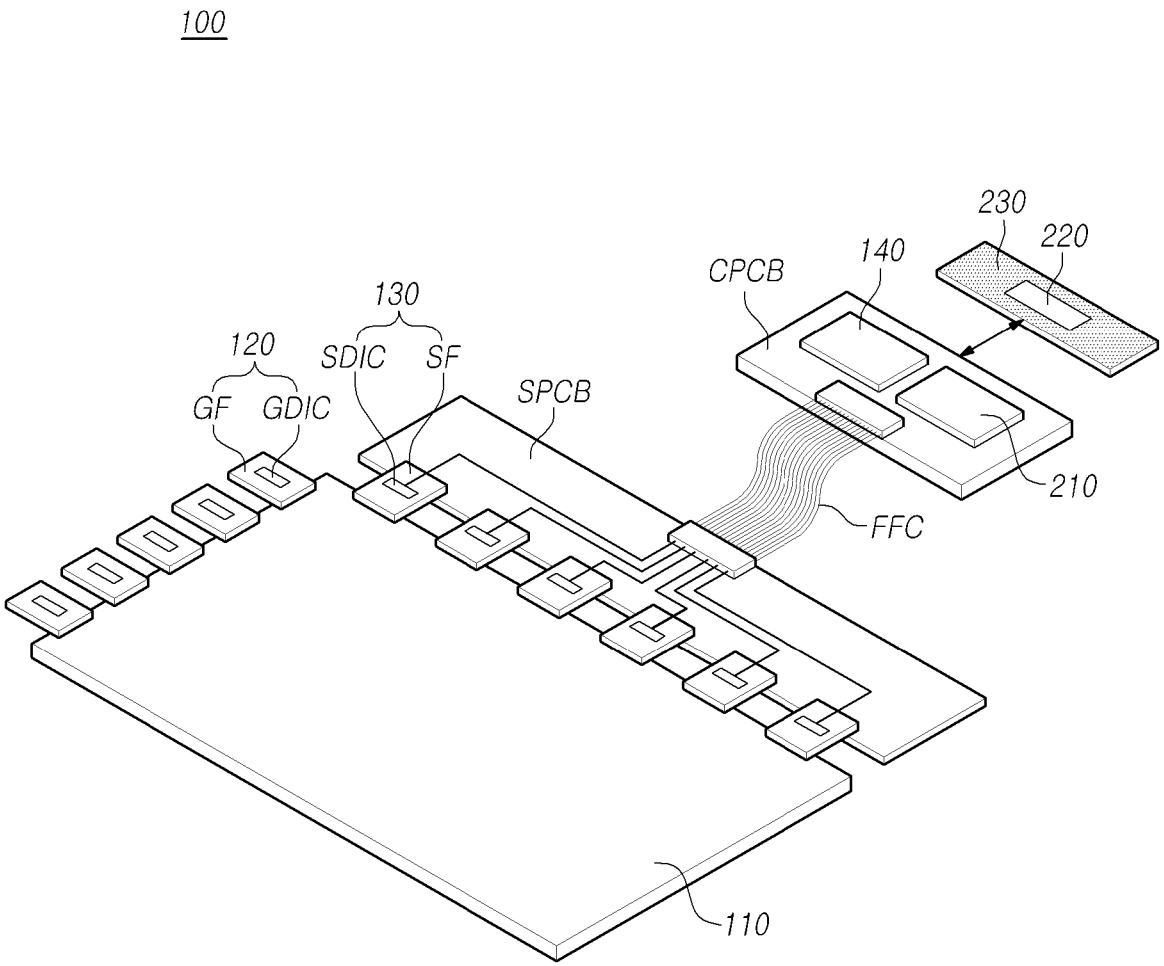
FIG. 2 illustrates a system of the display device according to one or more embodiments.

FIG. 2 illustrates a system of the display device according to one or more embodiments.

In the display device 100 illustrated in FIG. 2, each of the source driver ICs SDIC of the data driver circuit 130 is implemented using a COF structure among a plurality of structures, such as a TAB structure, a COG structure, and a COF structure, and the gate driver circuit 120 is implemented using a GIP structure among a variety of structures, such as a TAB structure, a COG structure, a COF structure, and a GIP structure.

The source driver ICs SDIC of the data driver circuit 130 may be mounted on source-side circuit films SF, respectively. One portion of each of the source-side circuit films SF may be electrically connected to the display panel 110. In addition, lines may be disposed in the top portion of the source-side circuit films SF to electrically connect the source driver ICs SDIC and the display panel 110.

The display device 100 may include at least one source printed circuit board SPCB and a control printed circuit board CPCB, on which control components and a variety of electric devices are mounted, in order to connect the plurality of source driver ICs SDIC to the circuits of the other devices.

The other portion of each of the circuit films SF, on which the source driver ICs SDIC are mounted, may be connected to the at least one source printed circuit board SPCB. That is, one portion of each of the circuit films SF, on which the source driver ICs SDIC are mounted, may be electrically connected to the display panel 110, while the other portion of each of the source-side circuit films SF may be electrically connected to the source printed circuit board SPCB.

The timing controller 140 and a power management IC (PMIC) 210 may be mounted on the control printed circuit board CPCB. The timing controller 140 may control the operations of the data driver circuit 130 and the gate driver circuit 120. The power management IC 210 may control various forms of voltage or current, including a driving voltage, to the data driver circuit 130, the gate driver circuit 120, and the like, or may control the voltage or current to be supplied to the same.

A circuit connection between the at least one source printed circuit board SPCB and the control printed circuit board CPCB may be provided by at least one connecting member. The connecting member may be, for example, a flexible printed circuit (FPC), a flexible flat cable (FFC), or the like. The at least one source printed circuit board SPCB and the control printed circuit board CPCB may be integrated into a single printed circuit board.

The display device 100 may further include a set board 230 electrically connected to the control printed circuit board CPCB. The set board 230 may also be referred to as a power board. A main power management circuit (M-PMC) 220 performing overall power management of the display device 100 may be present on the set board 230. The main power management circuit 220 may work in concert with the power management IC 210.

In the display device 100 having the above-described configuration, a driving voltage EVDD is generated by the set board 230 to be transferred to the power management IC 210. The power management IC 210 transfers the driving voltage EVDD, which is used during an image driving period or a sensing period, to the source printed circuit board SPCB through a flexible flat cable FFC, or via a flexible printed circuit (FPC). The driving voltage EVDD, transferred to the source printed circuit board SPCB, is supplied to a specific subpixel SP in the display panel 110 via the source driver ICs SDIC, so that the subpixel SP is lit or performs a sensing operation.

Each of the subpixels SP, arrayed in the display panel 110 of the display device 100, may include a light-emitting element, such as an organic light-emitting diode (OLED), and circuit elements, such as a driving transistor, driving the organic light-emitting diode.

The type and number of circuit elements of each of the subpixels SP may be variously determined, depending on the function provided, the design, or the like.

Figure 3:
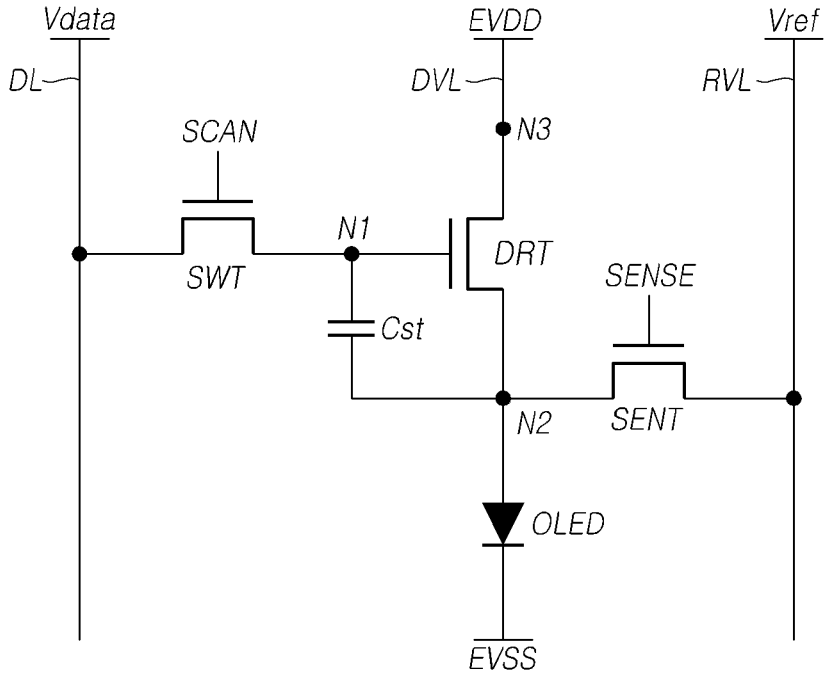
FIG. 3 illustrates a circuit structure of each of the subpixels arrayed in the display device according to one or more embodiments.

FIG. 3 illustrates a circuit structure of each of the subpixels SP arrayed in the display device according to one or more embodiments.

Referring to FIG. 3, each of the subpixels SP arrayed in the display device 100 according to one or more embodiments may include one or more transistors and a capacitor, with an organic light-emitting diode OLED being disposed therein. For example, the subpixel SP may include a driving transistor DRT, a switching transistor SWT, a sensing transistor SENT, a storage capacitor Cst, and the organic light-emitting diode OLED.

Here, the switching transistor SWT may be on-off controlled by a scan signal SCAN applied to a gate node thereof through a corresponding gate line. The sensing transistor SENT may be on-off controlled by a sense signal SENSE, different from the scan signal SCAN, applied to a gate node thereof through the corresponding gate line.

The driving transistor DRT has a first node N1, a second node N2, and a third node N3. The first node N1 of the driving transistor DRT may be a gate node, to which a data voltage Vdata is applied through a data line DL, when the switching transistor SWT is turned on. The second node N2 of the driving transistor DRT may be electrically connected to an anode of the organic light-emitting diode OLED, and may be a drain node or a source node.

Here, in the image driving period, the driving voltage EVDD for the image driving period may be supplied to the driving voltage line DVL. For example, the driving voltage EVDD for the image driving may be about 27 V.

The switching transistor SWT is electrically connected between the first node N1 of the driving transistor DRT and the data line DL. The switching transistor SWT operates in response to the scan signal SCAN supplied thereto through the gate line GL as the gate line GL is connected to the gate node. In addition, when the switching transistor SWT is turned on, the data voltage Vdata supplied through the data line DL is transferred to the gate node of the driving transistor DRT, thereby controlling the operation of the driving transistor DRT.

The sensing transistor SENT is electrically connected between the second node of the driving transistor DRT and a reference voltage line RVL, and operates in response to the sense signal SENSE supplied thereto through the gate line GL as the gate line GL is connected to the gate node. When the sensing transistor SENT is turned on, a reference voltage-for-sensing Vref supplied through the reference voltage line RVL is transferred to the second node N2 of the driving transistor DRT. That is, the voltages of the first node N1 and the second node N2 of the driving transistor DRT may be controlled by controlling the switching transistor SWT and the sensing transistor SENT. Consequently, a current for driving the organic light-emitting diode OLED can be supplied.

The switching transistor SWT and the sensing transistor SENT may be connected to a single gate line GL or to different signal lines. Hereinafter, a structure by which the switching transistor SWT and the sensing transistor SENT are connected to different signal lines will be described by way of example. In this case, the switching transistor SWT is controlled by the scan signal transferred through the gate line GL, and the sensing transistor SENT is controlled by the sense signal SENSE.

In addition, the transistors disposed in the subpixels SP may be not only n-type transistors, but also p-type transistors. Herein, the transistors are described as being n-type transistors by way of example.

The storage capacitor Cst is electrically connected between the first node N1 and the second node N2 of the driving transistor DRT, and serves to maintain the data voltage Vdata for a one-frame period.

Such a storage capacitor Cst may be connected between the first node N1 and the third node N3 of the driving transistor DRT, depending on the type of the driving transistor DRT. The anode of the organic light-emitting diode OLED may be electrically connected to the second node N2 of the driving transistor DRT, and a base voltage EVSS may be applied to a cathode of the organic light-emitting diode OLED. Here, the base voltage EVSS may be the ground voltage or a voltage higher or lower than the ground voltage. In addition, the base voltage EVSS may vary depending on the driving condition. For example, the base voltage EVSS at a point in time during the image driving may be set different from the base voltage EVSS at a point in time during the sensing driving.

The structure of the subpixel SP as described above has a 3T1C structure comprised of three transistors and one capacitor. However, this is merely for illustrative purposes, and one or more transistors, or in some cases, one or more capacitors may be further included. In addition, the plurality of subpixels SP may have the same structure, or some of the plurality of subpixels SP may have a different structure from the remaining subpixels.

The image driving in which the subpixels SP are lit may be performed by an image data writing step, a boosting step, and an emission step.

In the image data writing step, a data voltage-for-driving image Vdata corresponding to an image signal may be applied to the first node N1 of the driving transistor DRT, and an image-driving reference voltage Vref may be applied to the second node N2 of the driving transistor DRT. Here, a voltage similar to the image-driving reference voltage Vref may be applied to the second node N2 of the driving transistor DRT, due to a resistance component or the like between the second node N2 of the driving transistor DRT and the reference voltage line RVL. The image-driving reference voltage Vref is also indicated by VpreR. In the image data writing step, the storage capacitor Cst may be charged with an electric charge Vdata-Vref corresponding to a potential difference between both ends.

Application of the data voltage-for-driving image Vdata to the first node N1 of the driving transistor DRT is referred to as image data writing. In the boosting step subsequent to the image data writing step, the first node N1 and the second node N2 of the driving transistor DRT may be electrically floated. In this regard, the switching transistor SWT may be turned off by the scan signal SCAN having a turn-off level. In addition, the sensing transistor SENT may be turned off by the sense signal SENSE having a turn-off level.

In the boosting step, the voltage of the first node N1 and the voltage of the second node N2 of the driving transistor DRT may be boosted while the voltage difference between the first node N1 and the second node N2 of the driving transistor DRT is being maintained. When the boosted voltage of the second node N2 of the driving transistor DRT reaches a certain voltage level or higher through the boosting of the voltages of the first node N1 and the second node N2 of the driving transistor DRT during the boosting step, the operation enters the emission step. The certain voltage level is a voltage level by which the organic light-emitting diode OLED can be turned on.

In the emission step, driving current flows to the organic light-emitting diode OLED, so that the organic light-emitting diode OLED can emit light.

Here, the driving transistor DRT disposed in each of the plurality of subpixels SP has unique characteristics, such as threshold voltage and mobility. However, the driving transistor DRT may be deteriorated as the driving time elapses, and the unique characteristics of the driving transistor DRT may change according to the driving time.

When the characteristics of the driving transistor DRT change, on-off times thereof may be changed, or the driving performance of the organic light-emitting diode OLED may be changed. That is, points in time at which current is supplied to the organic light-emitting diode OLED and the amount of current supplied to the organic light-emitting diode OLED may change along with changes in the characteristics. Consequently, the characteristics of the driving transistor DRT may change, thereby changing the actual luminance level of the corresponding subpixel SP. In addition, since the plurality of subpixels SP, arrayed in the display panel 110, may have different driving times, the driving transistors DRT in the subpixels SP may have deviations in the characteristics, such as threshold voltage and mobility.

Such deviations in the characteristics among the driving transistors DRT may lead to different luminance levels among the subpixels SP. Accordingly, the luminance uniformity of the display panel 110 may be deteriorated, thereby degrading image quality.

The display device 100 according to one or more embodiments may use a method of measuring a charged voltage of the storage capacitor Cst in the sensing period of the driving transistor DRT in order to effectively sense characteristics (e.g., threshold voltage or mobility) of the driving transistor DRT. In this regard, according to one or more embodiments, the display device 100 may include a compensation circuit able to compensate for the characteristics deviations among the driving transistors DRT, and a compensation method using the compensation circuit may be provided.

That is, the characteristics or changes in the characteristics of the driving transistor DRT in the subpixel SP may be determined by measuring the charged voltage of the storage capacitor Cst in the sensing period of the driving transistor DRT. Here, the reference voltage line RVL may not only serve to transfer the reference voltage Vref but also serve as a sensing line to sense the characteristics of the driving transistor DRT in the subpixel SP. Thus, the reference voltage line RVL may also be referred to as a sensing line.

For example, in the display device 100 according to one or more embodiments, the characteristics or changes in the characteristics of the driving transistor DRT in the subpixel SP may correspond to a voltage difference, e.g., Vdata−Vref, between the first node N1 and the second node N2 of the driving transistor DRT.

Figure 4:
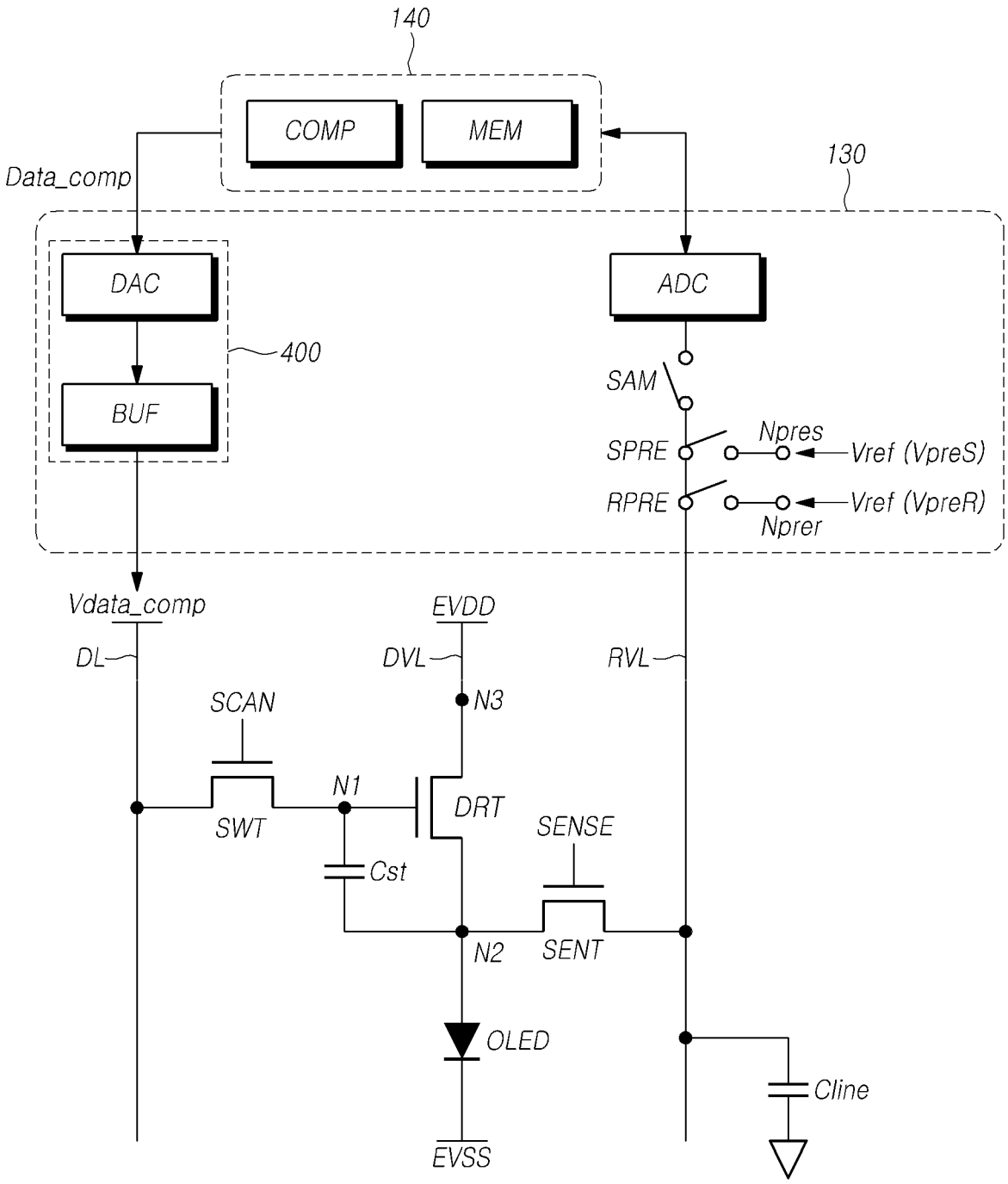
FIG. 4 illustrates a compensation circuit of the display device according to one or more embodiments.

FIG. 4 illustrates a compensation circuit of the display device according to one or more embodiments.

Referring to FIG. 4, the display device 100 according to one or more embodiments enables to sense the characteristics or changes in the characteristics of each of the driving transistors DRT in order to compensate for characteristics deviations among the transistors DRT. In this regard, the compensation circuit of the display device 100 according to one or more embodiments may include components for sensing the characteristics or changes in the characteristics of the driving transistors DRT in the subpixels SP in the sensing period, in a case in which each of the subpixels SP has a 3T1C structure or a modified structure based on the 3T1C structure.

In the sensing period, the display device 100 according to one or more embodiments may sense a voltage of the reference voltage line RVL and determine the characteristics or the change in the characteristics of the driving transistor DRT in the subpixel SP from the sensed voltage. The reference voltage line RVL may not only serve to transfer the reference voltage but also serve as a sensing line to sense the characteristics of the driving transistor DRT in the subpixel SP. Thus, the reference voltage line RVL may also be referred to as a sensing line.

Specifically, in the sensing period of the display device 100 according to one or more embodiments, the characteristics or changes in the characteristics of the driving transistor DRT may be reflected as a voltage, e.g., Vdata−Vth, of the second node N2 of the driving transistor DRT. The voltage of the second node N2 of the driving transistor DRT may correspond to the voltage of the reference voltage line RVL when the sensing transistor SENT is in a turned-on state. In addition, a line capacitor Cline on the reference voltage line RVL may be charged by the voltage of the second node N2 of the driving transistor DRT. Due to the charged line capacitor Cline, the reference voltage line RVL may have a voltage corresponding to the voltage of the node N2 of the driving transistor DRT.

The compensation circuit of the display device 100 according to one or more embodiments may perform compensation driving by on-off controlling the switching transistor SWT and the sensing transistor SENT in the subpixel SP serving as a sensing target, and controlling the supply of the data voltage Vdata and the reference voltage Vref, so that the second node N2 of the driving transistor DRT has a voltage condition reflecting the characteristics (e.g., threshold voltage or mobility) or a change in the characteristics of the driving transistor DRT.

The compensation circuit of display device 100 according to one or more embodiments may include an analog-to-digital converter ADC and a switch circuit SAM and SPRE. The analog-to-digital converter ADC measures the voltage of the reference voltage line RVL, corresponding to the voltage of the second node N2 of the driving transistor DRT, and converts the measured voltage into a digital value. The switch circuit SAM and SPRE is provided for sensing of the characteristics.

The switch circuit SAM and SPRE controlling the sensing driving may include a sensing reference switch SPRE controlling the connection between each reference voltage line RVL and a reference voltage-for-sensing supply node Npres, to which the reference voltage Vref is supplied, and a sampling switch SAM controlling the connection between the reference voltage line RVL and the analog-to-digital converter ADC. Here, the sensing reference switch SPRE is a switch controlling the sensing driving. Due to the sensing reference switch SPRE, the reference voltage Vref, supplied to the reference voltage line RVL, corresponds to a "reference voltage-for-sensing VpreS."

In addition, the switch circuit for sensing the characteristics of the driving transistor DRT may further include an image-driving reference switch RPRE used in the image driving. The image-driving reference switch RPRE may control connection between each reference voltage line RVL and an image-driving reference voltage supply node Nprer, to which the reference voltage Vref is supplied. The image-driving reference switch RPRE is a switch used in the image driving. Due to the image-driving reference switch RPRE, the reference voltage Vref, supplied to the reference voltage line RVL, corresponds to an "image-driving reference voltage VpreR."

Here, the sensing reference switch SPRE and the image-driving reference switch RPRE may be provided separately or integrated into a single switch. The reference voltage-for-sensing VpreS and the image-driving reference voltage VpreR may be the same value or different values.

In the compensation circuit of the display device 100 according to one or more embodiments, the timing controller 140 may include a memory MEM and a compensator COMP. The memory MEM stores a sensed value output by the analog-to-digital converter ADC, or retains a reference sensing value that has been previously stored. The compensator COMP determines a compensation value, by which a characteristics deviation is compensated for, by comparing the sensed value and the reference sensing value stored in the memory MEM. The compensation value determined by the compensator COMP may be stored in the memory MEM.

The timing controller 140 may change the data voltage Data in the form of a digital signal, supposed to be supplied to the data driver circuit 130, using the compensation value determined by the compensator COMP, and output the changed data voltage Data comp to the data driver circuit 130. Consequently, the characteristics deviations (e.g., the threshold voltage deviations or mobility deviations) of the driving transistor DRT of the corresponding subpixel SP can be compensated for.

In addition, the data driver circuit 130 may include a data voltage output circuit 400 including a latch circuit, a digital-to-analog converter DAC, an output buffer BUF, and the like. In some cases, the data driver circuit 130 may further include an analog-to-digital converter ADC and a plurality of switches SAM, SPRE, and RPRE. Alternatively, the analog-to-digital converter ADC and the plurality of switches SAM, SPRE, and RPRE may be located outside of the data driver circuit 130.

In addition, although the compensator COMP may be present outside of the timing controller 140, the compensator COMP may be included within the timing controller 140. The memory MEM may be located outside of the timing controller 140, or may be provided in the form of a register within the timing controller 140.

Figure 5:
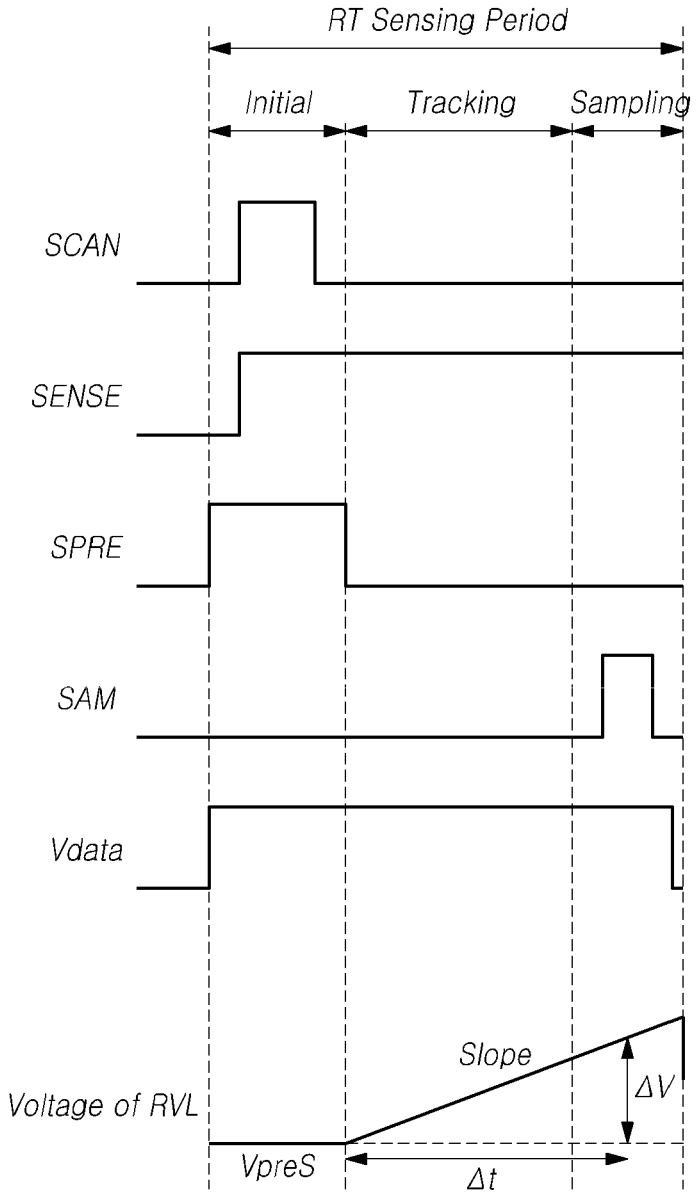
FIG. 5 illustrates a signal timing diagram of mobility sensing of characteristics of the driving transistor in the display device according to one or more embodiments.

FIG. 5 illustrates a signal timing diagram of mobility sensing of characteristics of the driving transistor in the display device according to one or more embodiments.

Referring to FIG. 5, in the organic light-emitting display device according to one or more embodiments, the characteristics sensing of the driving transistor DRT may be performed by the RT sensing process in which real-time sensing is performed in the blank period. In this case, the RT sensing period may be comprised of an initialization period, a tracking period, and a sampling period. Since the mobility of the driving transistor DRT is generally sensed by individually turning the switching transistor SWT and the sensing transistor SENT on and off, the sensing operation may be performed by individually applying a scan signal SCAN and a sense signal SENSE to the switching transistor SWT and the sensing transistor SENT through two gate lines GL, respectively.

In the initialization period, the switching transistor SWT is turned on by the turn-on level scan signal SCAN, and the first node N1 of the driving transistor DRT is initialized to the mobility data voltage-for-sensing Vdata. In addition, a turn-on level sense signal SENSE causes the sensing transistor SENT and sensing reference switch SPRE to be turned on. In this state, the second node N2 of the driving transistor DRT is initialized to the reference voltage-for-sensing VpreS.

The tracking period is a period in which the mobility of the driving transistor DRT is tracked. The mobility of the driving transistor DRT may indicate current driving ability of the driving transistor DRT. In the tracking period, the voltage of the second node N2 of the driving transistor DRT, by which the mobility of the driving transistor DRT can be determined, is tracked.

In the tracking period, the turn-off level scan signal SCAN turns off the switching transistor SWT, and the sensing reference switch SPRE transits to a turn-off level. Consequently, both the first node N1 and the second node N2 of the driving transistor DRT are floated, so that both the voltage of the first node N1 and the voltage of the second node N2 of the driving transistor DRT are increased. In particular, since the voltage of the second node N2 of the driving transistor DRT is initialized to the reference voltage-for-sensing VpreS, the voltage of the second node N2 of the driving transistor DRT starts to increase from the reference voltage-for-sensing VpreS. At this time, an increase in the voltage of the second node N2 of the driving transistor DRT causes a voltage increase in the reference voltage line RVL, since the sensing transistor SENT is in the turned-on state.

In the sampling period, the sampling switch SAM is turned on when a predetermined length of time Δt has passed from a point in time at which the voltage of the second node N2 of the driving transistor DRT started to increase. At this time, the analog-to-digital converter ADC may sense the voltage of the reference voltage line RVL connected by the sampling switch SAM, and may convert the sensed voltage into a digital sensed value. Here, the voltage sensed by the analog-to-digital converter ADC may correspond to a voltage VpreS+ΔV increased from the reference voltage-for-sensing VpreS by a predetermined increment ΔV (which is positive or negative).

The compensator COMP may determine the mobility of the driving transistor DRT in the corresponding subpixel SP, on the basis of the sensed value output from the analog-to-digital converter ADC, and may compensate for the deviation of the driving transistor DRT. The compensator COMP may determine the mobility of the driving transistor DRT, on the basis of the sensed value VpreS+ΔV measured by the sensing driving, the already-known reference voltage-for-sensing VpreS, and the length of time Δt that has passed.

That is, the mobility of the driving transistor DRT is proportional to a voltage change per hour ΔV/At of the reference voltage line RVL in the tracking period. In other words, the mobility of the driving transistor DRT is proportional to a slope in a voltage waveform of the reference voltage line RVL. Here, the mobility deviation compensation for the driving transistor DRT may mean the image data changing process, i.e., a calculation process of multiplying the image data with the compensation value.

Although the structure of each of the subpixels SP has been described as having the 3T1C structure comprised of three transistors and one capacitor by way of example, this is merely for illustrative purposes, and one or more transistors, or in some cases, one or more capacitors may be further included. In addition, the plurality of subpixels SP may have the same structure, or some of the plurality of subpixels SP may have a different structure from the remaining subpixels.

In this case, the period, in which the characteristics of the driving transistor DRT are sensed, may start before the start of the image driving after a power-on signal is generated. Such sensing and such a sensing process may also be referred to as on-sensing and an on-sensing process. In addition, the period, in which the characteristics of the driving transistor DRT are sensed, may start after the generation of the power-off signal. Such sensing and such a sensing process may also be referred to as off-sensing and an off-sensing process.

In addition, the sensing period for the driving transistor DRT may proceed in real time during the image driving, and thus, such a sensing process may also be referred to as a real-time (RT) sensing process. In the case of the RT sensing process, the sensing process may be performed on one or more subpixels SP in one or more subpixels lines for every blank period BP during the image driving.

When the RT sensing process is performed in the blank period BP, a line of subpixels SP, on which the sensing process is performed, may be selected randomly. Consequently, after the sensing process has been performed in the blank period BP, abnormal image quality, which would appear in the subsequent image driving period, may be reduced. In addition, after the RT sensing process has been performed during the blank period BP, a recovery data voltage may be supplied to the subpixel, on which the RT sensing process has been performed in the subsequent image driving period. Accordingly, after the RT sensing process has been performed in the blank period BP, abnormal image quality, which would appear in the subpixel line on which the RT sensing process has been completed in the subsequent image driving period, may be further reduced.

In addition, in the case of the threshold voltage sensing process for the driving transistor DRT, the off-sensing process that would take a rather long time may be performed, since the saturation of the voltage of the second node N2 of the driving transistor DRT may take a large amount of time. In contrast, in the case of the mobility sensing process for the driving transistor DRT, at least one of the on-sensing process or the RT sensing process that would take for a relatively-short time may be performed, since the mobility sensing process may require a shorter time than the threshold voltage sensing process.

Figure 6:
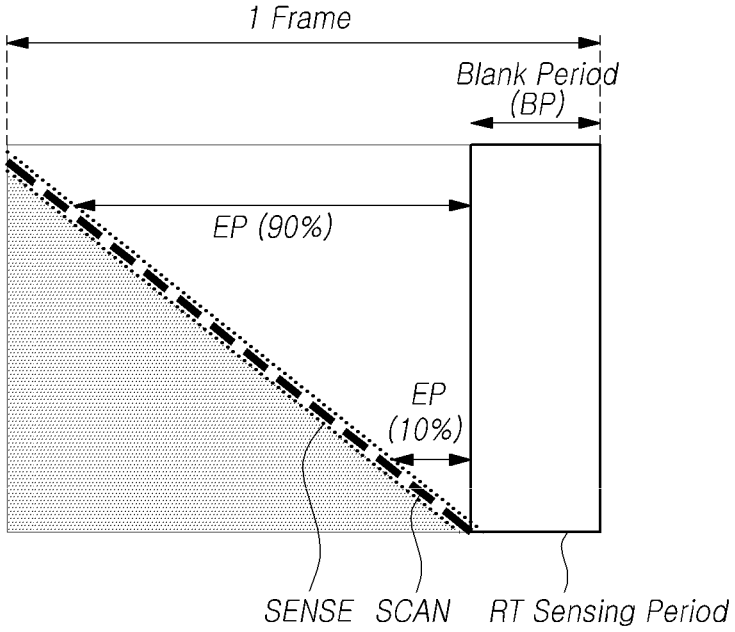
FIG. 6 illustrates a signal timing diagram of the image driving period in the display device according to one or more embodiments.

FIG. 6 illustrates a signal timing diagram of the image driving period in the display device according to one or more embodiments.

Referring to FIG. 6, in the display panel 110, a plurality of subpixels SP may be arrayed in rows and columns, in which a single gate line GL may be disposed in a corresponding row of subpixels SP, and a single data line DL may be disposed in a corresponding column of subpixels SP.

For example, in a case in which subpixels SP arrayed in the nth row of subpixels among the plurality of subpixels SP are driven, a scan signal SCAN and a sense signal SENSE are applied to the subpixels SP in the nth row of subpixels, and a data voltage-for-driving image Vdata is supplied to the subpixels SP in the nth row of subpixels through the plurality of data lines DL. When the image data is written in subpixels SP arrayed in the (n+1)th row of subpixels SP, subpixels SP arrayed in the (n+1)th row of subpixels SP positioned below the nth row of subpixels SP are driven subsequently. That is, subsequent to the nth row of subpixels SP, the scan signal SCAN and the sense signal SENSE are applied to the subpixels SP in the (n+1)th row of subpixels SP, and the data voltage-for-driving image Vdata is supplied to the subpixels SP in the (n+1)th row of subpixels SP through the plurality of data lines DL.

In this manner, the image data is written sequentially in the plurality of rows of subpixels SP. Here, the image data writing step, the boosting step, and the emission step may be performed sequentially on the plurality of rows of subpixels SP during a one-frame period.

Here, an emission period EP, in which the plurality of subpixels SP displays the image data, does not continue throughout the one-frame period. Thus, in a blank period BP in the one-frame period except for the emission period EP, the ground voltage may be applied or the RT sensing process for sensing characteristics of the organic light-emitting diodes OLEDs or the driving transistors DRT may be performed.

Accordingly, while the blank period BP is proceeding among the emission period EP, the data voltage Vdata applied to the subpixels SP changes, i.e., the data voltage Vdata increases and decreases.

Figure 7:
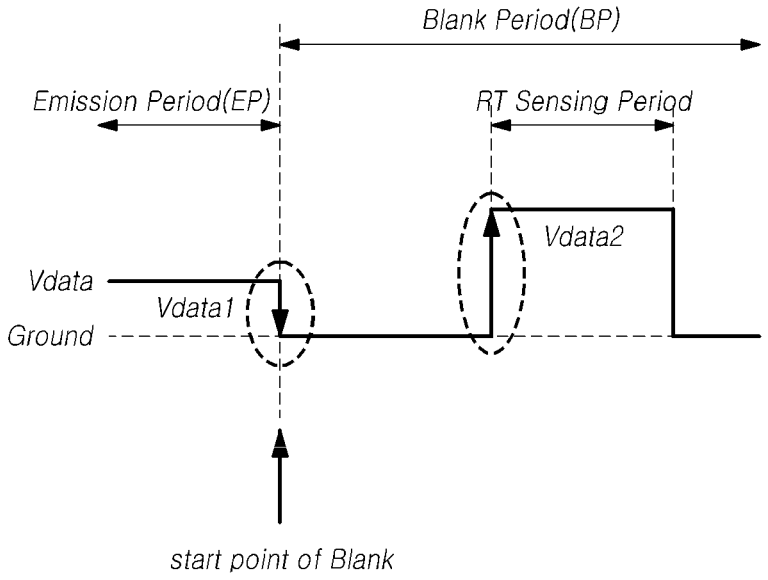
FIG. 7 illustrates a signal timing diagram of the data voltage applied to subpixels in the process in which the blank period is performed after the emission period in the display device according to one or more embodiments.

FIG. 7 illustrates a signal timing diagram of the data voltage Vdata applied to subpixels SP in the process in which the blank period BP is performed after the emission period EP in the display device according to one or more embodiments.

Referring to FIG. 7, in the display device 100, the data voltage Vdata has different values, depending on the emission period EP, the blank period BP, and the RT sensing period in which the data voltage Vdata is applied to the subpixel SP.

In the emission period EP in which an image is displayed on the display panel 110, a data voltage-for-driving image Vdata1 having a level, at which the organic light-emitting diode OLED in the subpixel SP is lit, is applied. The level of the data voltage-for-driving image Vdata1, applied with a low grayscale and at an initial point in time of driving, may be different from the level of the data voltage-for-driving image Vdata1 applied with a high grayscale and in the case of long-term driving. The level of the data voltage-for-driving image Vdata1, applied with a low grayscale and at an initial point in time of driving, may be lower than the level of the data voltage-for-driving image Vdata1 applied with a high grayscale and in the case of long-term driving.

When the emission period EP, in which an image is displayed on the display panel 110, is completed and the blank period BP starts, the data voltage Vdata is decreased to the ground level OV. Consequently, the driving transistor DRT is turned off, and no current flows to the organic light-emitting diode OLED, so that black is displayed on the corresponding subpixel SP. In this case, if the emission period EP corresponds to the low grayscale and the initial point in time of driving, the data voltage Vdata may be decreased to the level of the ground voltage by an insignificant difference at a start point of the blank period BP (i.e., a point in time at which the blank period BP starts), since the data voltage-for-driving image Vdata1 has been at a low level. In contrast, if the emission period EP corresponds to the high grayscale and the long-term driving, the data voltage Vdata may be decreased to the level of the ground voltage by a significant difference at the start point of the blank period BP, since the data voltage-for-driving image Vdata1 has been applied at a high level.

In addition, after a predetermined length of time from the start of the blank period BP, the RT sensing period, in which characteristics of the light-emitting diode OLED or the driving transistor DRT are sensed, starts, and a data voltage-for-sensing Vdata2 for the sensing of the characteristics of the light-emitting diode OLED or the driving transistor DRT may be applied through the data line DL.

Here, the data voltage-for-sensing Vdata2 may vary depending on the circuit device or the type of the characteristics to be sensed. For example, in the case of sensing a deterioration of the organic light-emitting diode OLED in the subpixel SP, the data voltage-for-sensing Vdata2 may be applied at a level of 15V. In the case of measuring the characteristics of the driving transistor DRT, the data voltage-for-sensing Vdata2 may be applied at a level of 14V.

In addition, at a start point of the RT sensing period (i.e., a point in time at which the RT sensing period starts), the level of the data voltage Vdata increases from the ground level to the data voltage-for-sensing Vdata2. Accordingly, at the point in time at which the RT sensing starts, an increment in the data voltage Vdata increases again.

As described above, while the display device 100 is being driven, the data voltage Vdata is decreased or increased at the start point of the blank period BP and the start point of the RT sensing period. In this case, with increases in the amount by which the data voltage Vdata is decreased or increased, coupling between the gate line GL and the reference voltage line RVL increases, so that a deviation may occur in the sensed value of the organic light-emitting diode OLED or the driving transistor DRT.

Figure 8:
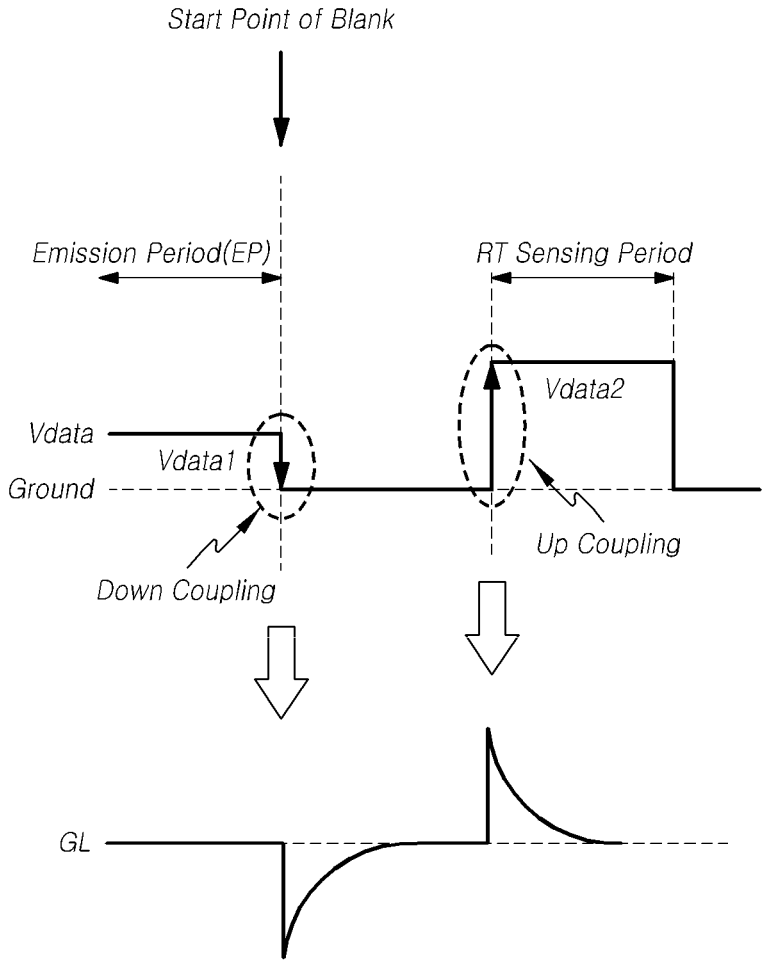
FIG. 8 illustrates a coupling voltage being induced in the gate line due to a change in the data voltage in the display device according to one or more embodiments.

FIG. 8 illustrates a coupling voltage being induced in the gate line GL due to a change in the data voltage Vdata in the display device according to one or more embodiments.

Referring to FIG. 8, when the blank period BP starts after the completion of the emission period EP in which an image is displayed on the display panel 110, the data voltage Vdata is decreased from the level of the data voltage-for-driving image Vdata1 to the ground level OV. At this time, with the data voltage Vdata being decreased in the downward direction, coupling occurs between a data line DL and an adjacent gate line GL, and thus, an instantaneous coupling voltage is induced to the gate line GL. In addition, the coupling voltage induced to the gate line GL influences the reference voltage line RVL, thereby generating a coupling voltage in the reference voltage line RVL. Here, the coupling voltage induced by down coupling, in which the data voltage Vdata is decreased, is indicated as being directed downward.

The magnitude of the coupling voltage, induced by a change in the data voltage Vdata, may be proportional to an increment in the data voltage Vdata. Since the induced coupling voltage decreases over time, the coupling voltage induced to the gate line GL may be dissipated after a predetermined length of time.

In addition, when the RT sensing period in which the characteristics of the organic light-emitting diode OLED or driving transistor DRT are sensed proceeds during the blank period BP, the data voltage Vdata increases from the ground level to the level of the data voltage-for-sensing Vdata2. At this time, with data voltage Vdata increasing in the upward direction, coupling reoccurs between a data line DL and an adjacent gate line GL, and thus, an instantaneous coupling voltage is induced to the gate line GL. Here, the coupling voltage induced by upward coupling, in which the data voltage Vdata increases, is indicated as being directed upward.

In the same manner, the magnitude of the up-coupling voltage, induced by a change in the data voltage Vdata, may be proportional to an increment in the data voltage Vdata. In addition, as the induced coupling voltage decreases over time, the coupling voltage induced to the gate line GL may be dissipated after a predetermined length of time.

However, if an interval of time between the start point of the blank period BP and the start point of the RT sensing period is narrow, or if a significant amount of coupling voltage is induced to the gate line GL due to a significant increment in the data voltage Vdata, the coupling voltage may not be dissipated at the start point of the RT sensing period.

In this case, the sensed values of the characteristics of the organic light-emitting diode OLED or the driving transistor DRT may be increased. Whenever the sensing is performed, the sensed values have different noise. Consequently, a compensation value for the organic light-emitting diode OLED or the driving transistor DRT may be inaccurate, so that a quality defect in the shape of horizontal stripes may appear on the display panel 110.

Figure 9:
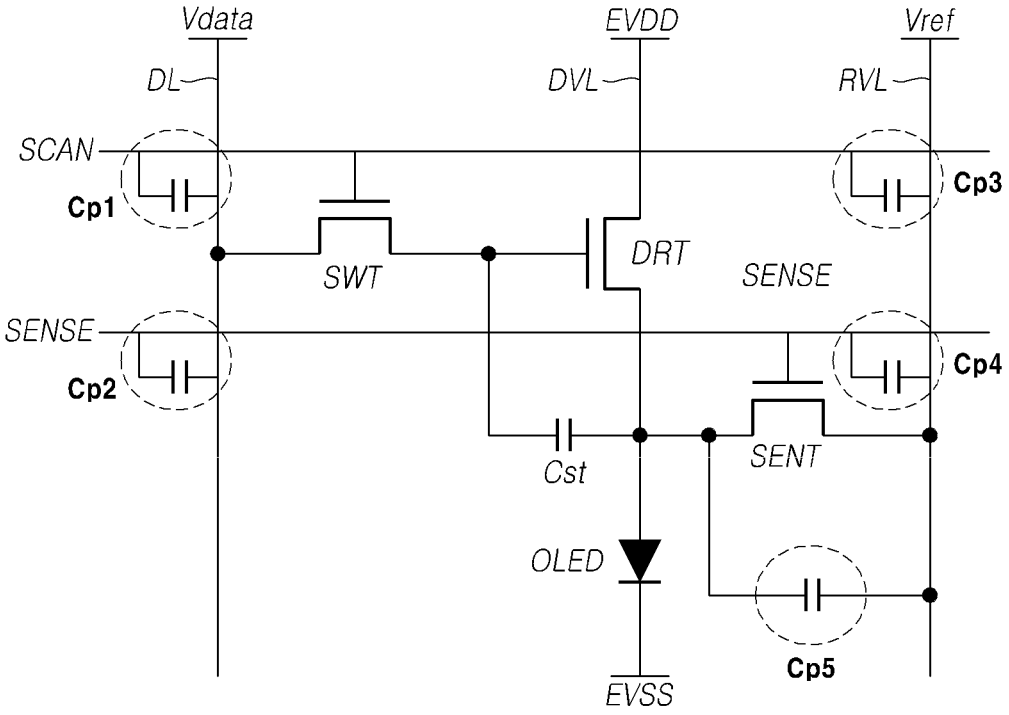
FIG. 9 is a circuit diagram illustrating coupling between the gate line and the reference voltage line due to changes in the data voltage in the display device.
Figure 10:
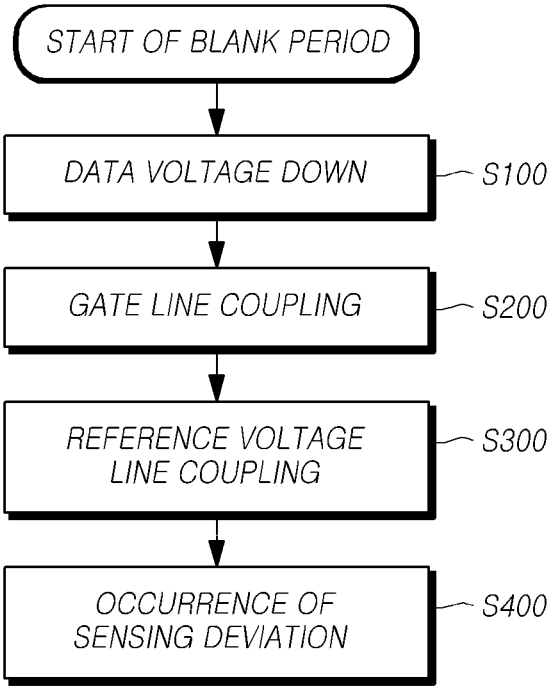
FIG. 10 is a flowchart illustrating coupling due to changes in the data voltage in the display device.

FIG. 9 is a circuit diagram illustrating coupling between the gate line GL and the reference voltage line RVL due to changes in the data voltage Vdata, and FIG. 10 is a flowchart illustrating coupling due to changes in the data voltage Vdata. Here, the gate line GL connected to the switching transistor SWT and the gate line GL connected to the sensing transistor SENT are discriminatively indicated as a scan signal SCAN and a sense signal SENSE.

Referring to FIGS. 9 and 10, in S100, a data voltage-for-driving image Vdata1, applied through the data line DL during the emission period EP, is decreased to the level of the ground voltage at an ending time point of the emission period EP (i.e., a point in time at which the emission period EP is completed) and the blank period BP starts. In S200, instantaneous coupling voltages are induced to the gate lines GL, due to the difference between the data voltage-for-driving image Vdata1 and the ground voltage. The instantaneous coupling voltages may be indicated as coupling capacitances Cp1 and Cp2.

In S300, the coupling voltages or coupling capacitances Cp1 and Cp2, induced between the gate lines GL (SCAN and SENSE) and the data line DL, induce coupling voltages between the gate lines GL and the reference voltage line RVL. These coupling voltages may be indicated as coupling capacitances Cp3, Cp4, and Cp5.

If the coupling voltages, induced between the gate lines GL and the data line DL, and the coupling voltages, induced between the gate lines GL and the reference voltage line RVL, remain instead of being dissipated, a sensing deviation may occur in the characteristics of the organic light-emitting diode OLED or the driving transistor DRT sensed in the RT sensing period in S400. Consequently, accurate compensation for the organic light-emitting diode OLED or the driving transistor DRT may not be performed, thereby producing an image quality defect.

Since the magnitude of the coupling voltages is proportional to the increment in the data voltage Vdata, a method of reducing the increment in the data voltage Vdata while achieving an effect in that the interval of time of applications of the data voltage Vdata is increased may be regarded as a method of minimizing (or reducing) the coupling effect.

Accordingly, the present disclosure is intended to reduce or minimize an increment in the data voltage Vdata at a start point of the blank period BP and a start point of the RT sensing period, thereby reducing or minimizing sensing deviations in the characteristics of the light-emitting diode OLED or the driving transistor DRT caused by coupling.

In this regard, the present disclosure controls the data voltage Vdata, applied between the start point of the blank period BP and the start point of the RT sensing period, to gradually increase in the blank period BP, instead of being decreased to the ground level. In this case, a method of gradually increasing the data voltage Vdata may change the data voltage Vdata according to the rising slope thereof or gradually by calculating a difference in the voltage and a difference in the time between the start point of the blank period BP and the start point of the RT sensing period.

Figure 11:
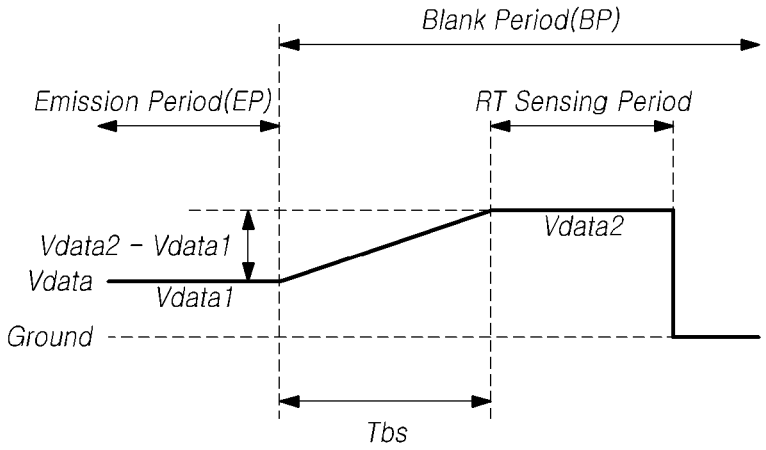
FIG. 11 is a diagram illustrating changes in the data voltage in the emission period, the blank period, and the real-time (RT) sensing period in the display device according to one or more embodiments.

FIG. 11 is a diagram illustrating changes in the data voltage Vdata in the emission period EP, the blank period BP, and the RT sensing period in the display device according to one or more embodiments.

Referring to FIG. 11, in the display device according to one or more embodiments, the data voltage Vdata maintains the level of the data voltage-for-driving image Vdata1 in the emission period EP in which an image data is displayed on the display panel 110.

Here, the timing controller 140 retains magnitudes of the data voltage-for-sensing Vdata2 for the sensing of the characteristics of the organic light-emitting diode OLED or the driving transistor DRT, stored in the memory MEM. Thus, the data voltage Vdata is not decreased to the ground level at a ending time point of the emission period EP and the blank period BP starts, but the data voltage Vdata is gradually increased to reach the level of the data voltage-for-sensing Vdata2 at the start point of the RT sensing period.

That is, a voltage difference Vdata2−Vdata1 corresponding to the difference between the data voltage-for-driving image Vdata1, applied to the display panel 110 in the emission period EP, and the data voltage-for-sensing Vdata2, stored in the memory MEM, is gradually increased during an interval of time Tbs between the start point of the blank period BP and the start point of the RT sensing period, so that the data voltage Vdata is not decreased to the ground level at the start point of the blank period BP.

In this regard, the timing controller 140 calculates the voltage difference Vdata2−Vdata1 between the data voltage-for-driving image Vdata1 and the data voltage-for-sensing Vdata2, stored in the memory MEM, before the emission period EP is completed, and divides the voltage difference Vdata2−Vdata1 with the interval of time Tbs between the start point of the blank period BP (or the ending time point of the emission period EP) and the start point of the RT sensing period, thereby calculating the rising slope of the data voltage Vdata.

Afterwards, the data voltage-for-driving image Vdata1 is increased according to the above-calculated rising slope, from the start point of the blank period BP (or the ending time point of the emission period EP) to the start point of the RT sensing period. Thus, the data voltage Vdata starts to increase from the data voltage-for-driving image Vdata1 at the start point of the blank period BP (or the ending time point of the emission period EP), and at the start point of the RT sensing period, reaches the level of the data voltage-for-sensing Vdata2.

For example, a case in which the data voltage-for-driving image Vdata1 is 5V, data voltage-for-sensing Vdata2 is 15V, and the interval of time Tbs from the start point of the blank period BP (or the ending time point of the emission period EP) to the start point of the RT sensing period may be considered. In this case, the rising slope of the data voltage Vdata may be (15V−5V)/10 μs=1V/μs.

Accordingly, the data voltage-for-driving image Vdata1 maintains 5V during the emission period EP, and the data voltage Vdata increases according to the slope of 1V/μs from the data voltage-for-driving image Vdata1 of 5V at the ending time point of the emission period EP and the blank period BP starts (or the ending time point of the emission period EP). After 10 μs, at the start point of the RT sensing period, the data voltage Vdata will reach the level of the data voltage-for-sensing Vdata2 of 15V.

Accordingly, in the display device 100 according to the present disclosure, the data voltage Vdata is not instantaneously decreased or increased at the start point of the blank period BP (or the ending time point of the emission period EP) and the start point of the RT sensing period, but is gradually increased in the interval between the start point of the blank period BP (or the ending time point of the emission period EP) and the start point of the RT sensing period. Consequently, the coupling voltage induced to gate lines GL and reference voltage line RVL due to instantaneous changes in the data voltage Vdata can be reduced or minimized, thereby reducing deviations in the sensing of characteristics of circuit elements and improving image quality.

In particular, since the data voltage Vdata corresponds to a value obtained by converting the image data, transferred from the timing controller 140, into an analog voltage by the data driver circuit 130, the timing controller 140 can control the data voltage Vdata to gradually increase in the interval of time Tbs between the start point of the blank period BP (or the ending time point of the emission period EP) and the start point of the RT sensing period. In addition, a circuit module able to adjust the data voltage Vdata may be additionally provided within the data driver circuit 130.

In addition, the display device 100 according to the present disclosure may control the data voltage Vdata to gradually increase in the interval between the start point of the blank period BP (or the ending time point of the emission period EP) and the start point of the RT sensing period.

Figure 12:
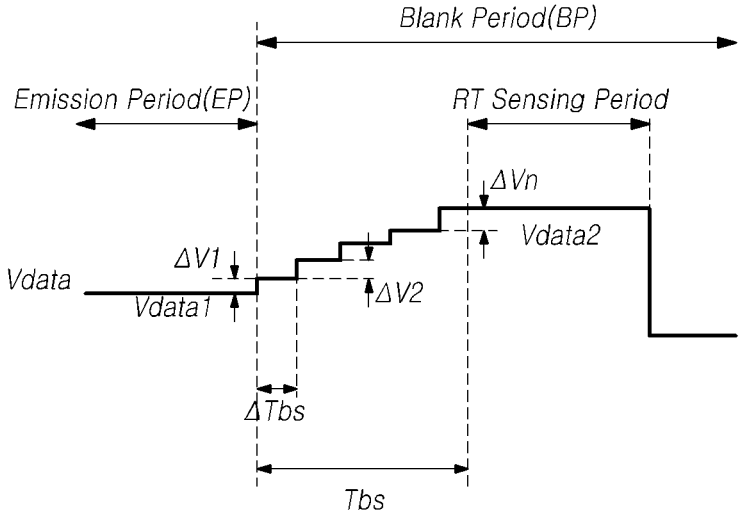
FIG. 12 is a diagram illustrating gradual changes in the data voltage in the blank period and the RT sensing period in the display device according to one or more embodiments.

FIG. 12 is a diagram illustrating gradual changes in the data voltage Vdata in the blank period BP and the RT sensing period in the display device according to one or more embodiments.

Referring to FIG. 12, the display device 100 according to the present disclosure may divide the interval of time Tbs between the start point of the blank period BP (or the ending time point of the emission period EP) and the start point of the RT sensing period by time division. Here, the interval of time Tbs between the start point of the blank period BP (or the ending time point of the emission period EP) and the start point of the RT sensing period may be changed by the unit of a data enable (DE) signal. Thus, in a case in which the data enable signal can be divided into n number of fractions, the interval of time Tbs between the start point of the blank period BP (or the ending time point of the emission period EP) and the start point of the RT sensing period can be set to be n number of time periods ΔTbs, based on the number n by which the data enable signal is divided. In addition, the interval of time Tbs between the start point of the blank period BP and the start point of the RT sensing period may be set to be a greater number of time periods Tbs than the n number of fractions of the data enable signal.

In addition, in a case in which the interval of time Tbs between the start point of the blank period BP (or the ending time point of the emission period EP) and the start point of the RT sensing period is divided into n number of time periods ΔTbs, the data voltage Vdata may be changed during each of the time periods ΔTbs, so that the increment ΔV of the data voltage Vdata may be divided into n number of fractions ΔV1, ΔV2, . . . , and ΔVn. Here, the increment ΔV of the data voltage Vdata may not be set to be smaller than the resolution Vdata(s) of the data voltage applied through the data line DL.

Hereinafter, descriptions will be provided on several embodiments in which the data voltage Vdata is gradually changed by dividing the interval of time Tbs between the start point of the blank period BP (or the ending time point of the emission period EP) and the start point of the RT sensing period into a plurality of time periods ΔTbs.

Figure 13:
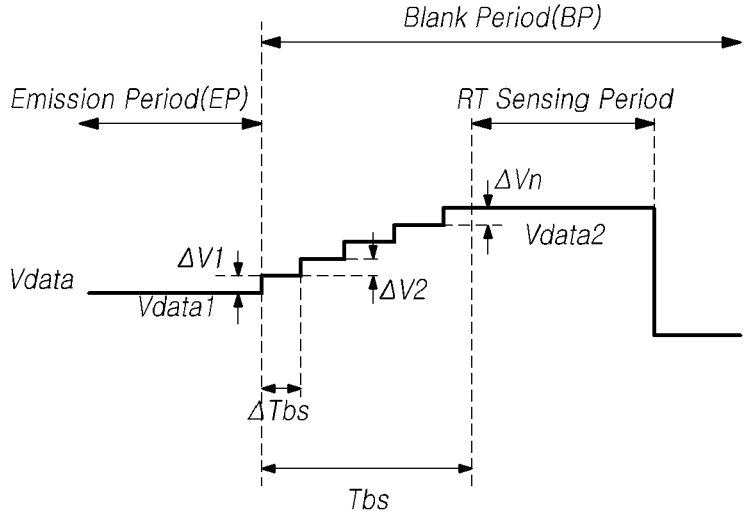
FIG. 13 is a signal diagram illustrating a case in which a value, obtained by dividing the difference between the data voltage-for-sensing and the data voltage-for-driving image with a number by which a data enable signal is divided, is a multiple of the resolution of the data voltage in the display device according to one or more embodiments.

FIG. 13 is a signal diagram illustrating a case in which a value, obtained by dividing the difference between the data voltage-for-sensing Vdata2 and the data voltage-for-driving image Vdata1 with the number n by which the data enable signal is divided, is a multiple of the resolution Vdata(s) of the data voltage in the display device according to one or more embodiments.

For example, in a case in which the interval of time Tbs between the start point of the blank period BP (or the ending time point of the emission period EP) and the start point of the RT sensing period is divided into ten time periods ΔTbs, in a case in which the data voltage-for-driving image Vdata1 is 5V and the data voltage-for-sensing Vdata2 is 15V, the result is (Vdata2−Vdata1)/n=(15V−5V)/10=1V, the same as the resolution Vdata(s) of the data voltage.

In this case, during the ten time periods ΔTbs in the interval of time Tbs between the start point of the blank period BP (or the ending time point of the emission period EP) and the start point of the RT sensing period, the data voltage Vdata may be increased by 1V in a stepwise manner. At the start point of the RT sensing period, the data voltage Vdata reaches the data voltage-for-sensing Vdata2 of 15V.

Figure 14:
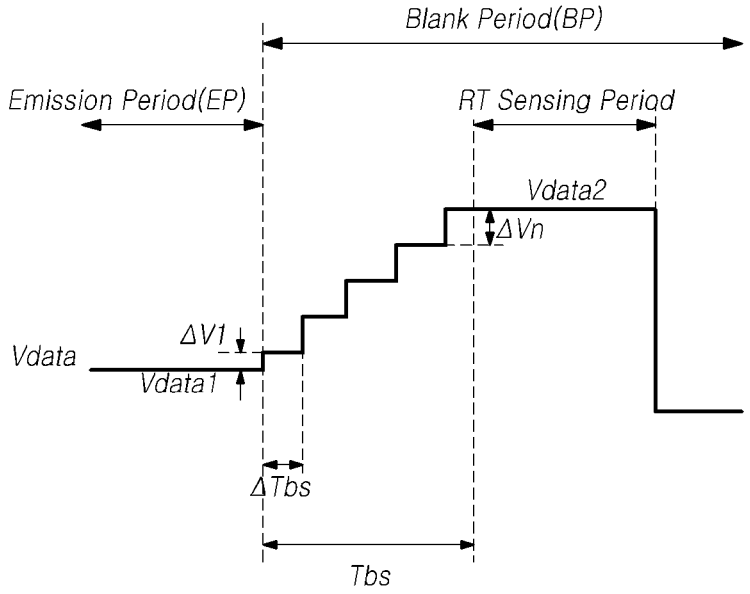
FIG. 14 is a signal diagram illustrating a case in which a value, obtained by dividing the difference between the data voltage-for-sensing and the data voltage-for-driving image Vdata1 with the number n of the fractions of the data enable signal, is not a multiple K of the resolution of the data voltage (where K is a natural number)

FIG. 14 is a signal diagram illustrating a case in which a value, obtained by dividing the difference between the data voltage-for-sensing Vdata2 and the data voltage-for-driving image Vdata1 with the number n of the fractions of the data enable signal, is not a multiple K of the resolution Vdata(s) of the data voltage (where K is a natural number). This may also correspond to a case in which the difference between the data voltage-for-sensing Vdata2 and the data voltage-for-driving image Vdata1 is not the multiple K of the resolution Vdata(s) of the data voltage (where K is a natural number).

For example, a case in which the interval of time Tbs between the start point of the blank period BP (or the ending time point of the emission period EP) and the start point of the RT sensing period is divided by ten time periods ΔTbs and the resolution Vdata(s) of the data voltage is 1V, the data voltage-for-driving image Vdata1 is 10.5V, and the data voltage-for-sensing Vdata2 is 15V may be considered.

From this case, obtained is (Vdata2−Vdata1)/n=(15V−10.5V)/10=0.45V, in which the increment ΔV of the data voltage Vdata is smaller than the resolution Vdata(s) of the data voltage. Thus, the data voltage Vdata cannot be increased by the same increment ΔV during the ten time periods ΔTbs. In this case, it is beneficial to asymmetrically change the increment ΔV during the ten time periods ΔTbs.

For example, the data voltage Vdata may be maintained to be the same as the data voltage-for-driving image Vdata1 during some front time periods (e.g., ΔTbs1, and ΔTbs5) among the ten time periods ΔTbs, while the data voltage Vdata may be increased in remaining subsequent time periods (e.g., ΔTbs6, . . . , and ΔTbs10) among the ten time periods ΔTbs such that the increment ΔV is 0.5V during the sixth time period ΔTbs6 and 1V during the seventh to tenth time periods ΔTbs7, . . . , and ΔTbs10.

It is not necessarily required to divide the interval of time Tbs between the start point of the blank period BP and the start point of the RT sensing period with the number n of the data enable signal. That is, even in the case that the data enable signal is divided by the number 10, the interval of time Tbs may be divided into five time periods ΔTbs, and the data voltage Vdata may be changed at intervals of five time periods ΔTbs.

For example, a method of dividing the interval of time Tbs into five time periods ΔTbs1 to ΔTbs5, increasing the data voltage by 0.5V during the first time period ΔTbs1, and increasing the data voltage by 1V during the four time periods ΔTbs2 to ΔTbs5 may be used. Even in the case that the data voltage Vdata is sequentially changed by this method, at the start point of the RT sensing period, the data voltage Vdata has the same level as the data voltage-for-sensing Vdata2.

In this case, it is possible to reduce or minimize the increment ΔV in the data voltage Vdata at a start point in time of the blank period BP, in which the data voltage Vdata starts to be changed, i.e., a front time period ΔTbs among the entire time periods ΔTbs, in order to reduce or minimize the coupling effect due to a change in the data voltage Vdata. Accordingly, in a case in which the data voltage Vdata has different amounts of change ΔV) throughout the time periods ΔTbs, the data voltage Vdata may be changed by a smaller increment in front time periods while being changed by a greater increment in subsequent time periods.

In contrast, in a case in which the data voltage Vdata has different amounts of change ΔV) throughout the time periods ΔTbs, the data voltage Vdata may be changed by a greater increment in front time periods while being changed by a smaller increment in subsequent time periods.

Figure 15:
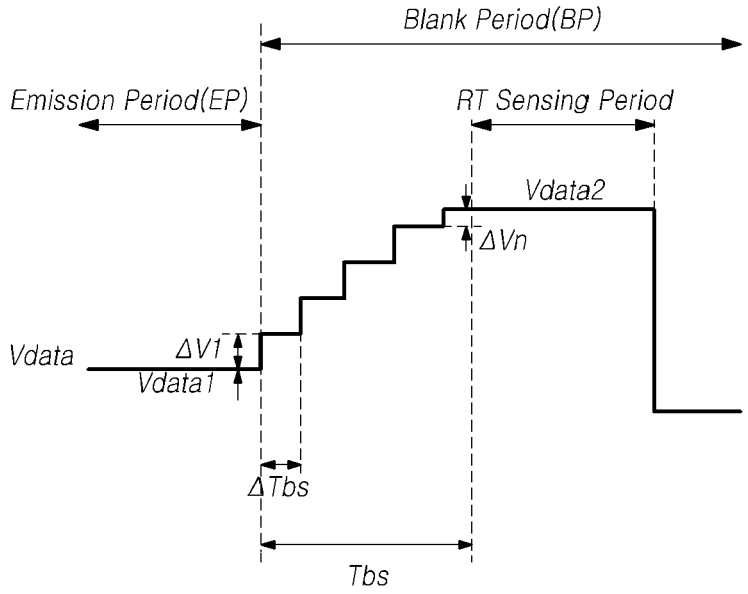
FIG. 15 is a signal diagram illustrating a case in which the data voltage is changed by a greater increment in front time periods and is changed by a smaller increment in subsequent time periods, contrary to the case of FIG. 14.

FIG. 15 is a signal diagram illustrating a case in which the data voltage Vdata is changed by a greater increment in front time periods and is changed by a smaller increment in subsequent time periods, contrary to the case of FIG. 14.

Figure 16:
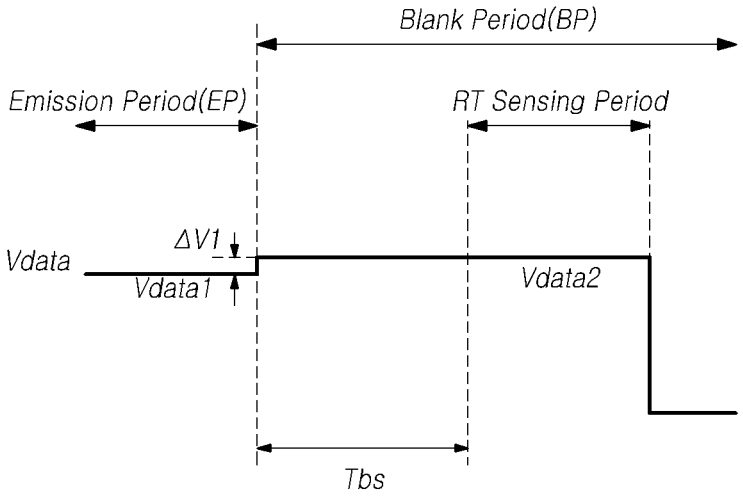
FIG. 16 is a signal diagram illustrating a case in which the difference between the data voltage-for-sensing and the data voltage-for-driving image is the same as or smaller than the resolution of the data voltage.

FIG. 16 is a signal diagram illustrating a case in which the difference between the data voltage-for-sensing Vdata2 and the data voltage-for-driving image Vdata1 is the same as or smaller than the resolution Vdata(s) of the data voltage.

For example, a case in which the interval of time Tbs between the start point of the blank period BP (or the ending time point of the emission period EP) and the start point of the RT sensing period is divided into ten time periods ΔTbs, the resolution Vdata(s) of the data voltage is 1V, the data voltage-for-driving image Vdata1 is 14V, and the data voltage-for-sensing Vdata2 is 15V may be considered.

From this case, obtained is (Vdata2−Vdata1)=(15V−14V)=1V, in which the increment ΔV in the data voltage Vdata is the same as the resolution Vdata(s) of the data voltage. Thus, it is impossible to increase the data voltage Vdata by dividing the interval of time into ten time periods ΔTbs. In this case, the data voltage Vdata can be increased by an increment corresponding to the difference between the data voltage-for-sensing Vdata2 and the data voltage-for-driving image Vdata1 at the start point of the blank period BP (or the ending time point of the emission period EP) or at the start point of the RT sensing period. Herein, a case in which the data voltage Vdata is increased at the start point of the blank period BP (or the ending time point of the emission period EP) is described.

Figure 17:
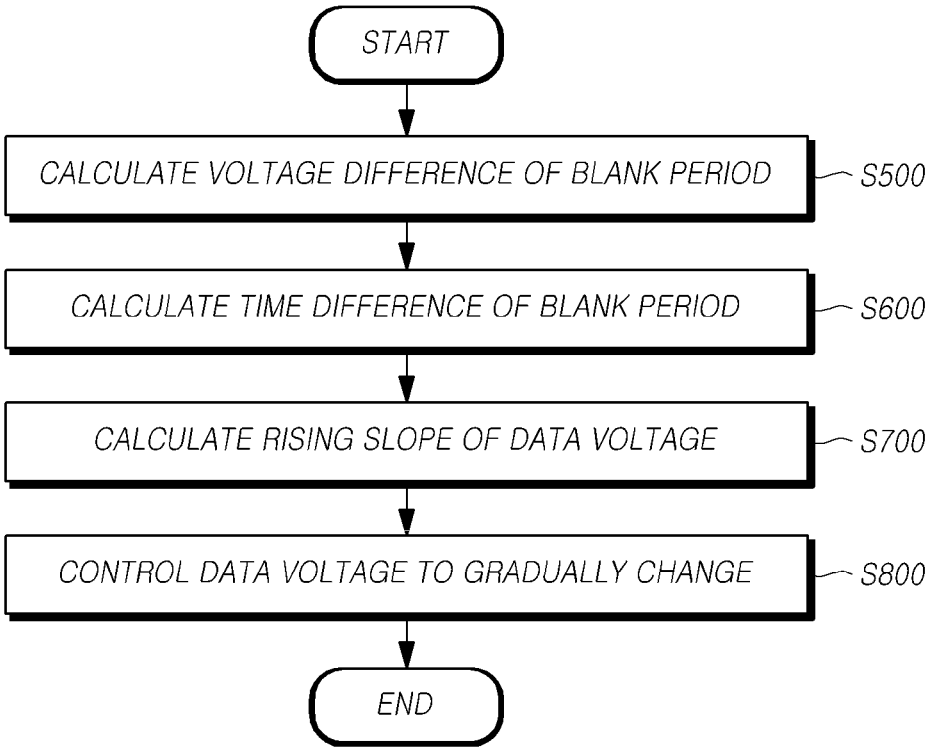
FIG. 17 is a flowchart illustrating a process of gradually changing the data voltage in a blank period in a method of driving a display device according to one or more embodiments.

FIG. 17 is a flowchart illustrating a process of gradually changing the data voltage Vdata in a blank period in a method of driving a display device according to one or more embodiments.

Referring to FIG. 17, the method of driving a display device according to one or more embodiments may include: step S500 of calculating a voltage difference of a blank period BP; step S600 of calculating an interval of time (or time difference) of the blank period BP; step S700 of calculating a rising slope of the data voltage Vdata; and step S800 of controlling the data voltage Vdata to gradually change in the blank period BP.

The step S500 of calculating the voltage difference of the blank period BP is a step of calculating, by the timing controller 140, the voltage difference Vdata2−Vdata1 between the data voltage-for-driving image Vdata1 and the data voltage-for-sensing Vdata2 stored in the memory MEM before the emission period EP is completed.

The step S600 of calculating the interval of time of the blank period BP is a step of calculating the interval of time Tbs between the start point of the blank period BP (or the ending time point of the emission period EP) and the start point of the RT sensing period.

The step S700 of calculating the rising slope of the data voltage Vdata is a step of calculating the rising slope of the data voltage Vdata by dividing the above-calculated voltage difference Vdata2−Vdata1 with the interval of time Tbs.

The step S800 of controlling the data voltage Vdata to gradually change in the blank period BP is a step of gradually increasing the data voltage-for-driving image Vdata1 on the above-calculated rising slope, from the start point of the blank period BP (or the ending time point of the emission period EP) to the start point of the RT sensing period. As described above, the method of gradually increasing the data voltage Vdata may equally change the data voltage according to the calculated rising slope or may gradually change the data voltage.

Accordingly, the data voltage Vdata starts to increase from data voltage-for-driving image Vdata1 at the start point of the blank period BP (or the ending time point of the emission period EP), and reaches the level of the data voltage-for-sensing Vdata2 at the start point of the RT sensing period. Accordingly, it is possible to reduce or minimize a coupling voltage induced to the gate lines GL and the reference voltage lines RVL due to an instantaneous change in the data voltage Vdata, thereby reducing deviations in the sensing of characteristics of circuit elements and improving image quality.

Although the display device has been described as being an organic light-emitting display device by way of example, a person having ordinary skill in the art will appreciate that the principle of the present disclosure can be applied to other display devices than the organic light-emitting display device.

The various embodiments described above can be combined to provide further embodiments. Further changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel including a plurality of gate lines, a plurality of data lines, and a plurality of subpixels;

a gate driver circuit configured to drive the plurality of gate lines;

a data driver circuit configured to drive the plurality of data lines; and a timing controller; that includes a memory configured to store a data voltage-for-sensing to sense a characteristic of a circuit element, the timing controller being configured to control signals applied to the gate driver circuit and the data driver circuit, wherein the timing controller is further configured to control the data driver circuit to gradually change a data voltage from a start point of a blank period to a start point of a sensing period based on a rising slope of the data voltage, and wherein the rising slope of the data voltage is configured to be calculated using a voltage difference between the data voltage at the start point of the blank period and the data voltage at the start point of the sensing period, and a time difference between the start point of the blank period and the start point of the sensing period.

2. The display device according to claim 1, wherein the data voltage at the start point of the blank period corresponds to a data voltage-for-driving image to be applied in an emission period of the display panel at a point in time before the blank period starts.

3. The display device according to claim 1, wherein the data voltage at the start point of the sensing period corresponds to the data voltage-for-sensing to be applied to the display panel after the gradual change to the data voltage is completed.

4. The display device according to claim 1, wherein each of the plurality of subpixels comprises:

an organic light-emitting diode;

a driving transistor configured to drive the organic light-emitting diode;

a switching transistor electrically connected between a gate node of the driving transistor and a data line among the plurality of data lines;

a sensing transistor electrically connected between a source node or a drain node of the driving transistor and a reference voltage line; and a storage capacitor electrically connected between a gate node and a source node or a drain node of the switching transistor.

5. The display device according to claim 4, further configured to perform a process of sensing a characteristic of the organic light-emitting diode or the driving transistor in the sensing period.

6. The display device according to claim 5, wherein the process of sensing the characteristic of the driving transistor includes:

an initialization period in which the data voltage-for-sensing is supplied through the data line, and a reference voltage-for-sensing is supplied through the reference voltage line in a state the switching transistor is turned on;

a tracking period in which a voltage of the reference voltage line is increased in response to the reference voltage-for-sensing being blocked; and a sampling period in which the characteristic of the driving transistor is sensed through the reference voltage line.

7. The display device according to claim 6, further comprising a compensation circuit configured to determine a compensation value for an image data voltage using a sensed value of the characteristic of the driving transistor and configured to apply a corrected image data voltage according to the determined compensation value to a corresponding subpixel among the plurality of subpixels.

8. The display device according to claim 7, wherein the compensation circuit includes:

an analog-to-digital converter configured to measure a voltage of a reference voltage line electrically connected to the driving transistor and to convert the measured voltage into a digital value;

a switch circuit electrically connected between the driving transistor and the analog-to-digital converter configured to control an operation of sensing the characteristic of the driving transistor;

a compensator configured to compare the sensed value with the reference sensing value stored in the memory to determine the compensation value, by which a characteristic deviation of the driving transistor is compensated for;

a digital-to-analog converter configured to convert the image data voltage, changed according to the compensation value determined by the compensator, into an analog image data voltage; and a buffer configured to output the analog image data voltage supplied from the digital-to-analog converter to a data line designated from among the plurality of data lines, wherein the memory is further configured to store the sensed value supplied from the analog-to-digital converter or to retain a reference sensing value previously stored therein.

9. A display device, comprising:

a display panel including a plurality of gate lines, a plurality of data lines, and a plurality of subpixels;

a gate driver circuit configured to drive the plurality of gate lines;

a data driver circuit configured to drive the plurality of data lines; and a timing controller that includes a memory configured to store a data voltage-for-sensing to sense a characteristic of a circuit element, the timing controller configured to control signals applied to the gate driver circuit and the data driver circuit, wherein the timing controller is further configured to control the data driver circuit to gradually change a data voltage from a start point of a blank period to a start point of a sensing period, and wherein the timing controller controlling the data driver circuit to gradually change the data voltage is configured to:

divide a time difference between the start point of the blank period and the start point of the sensing period into n number of time periods;

divide a voltage difference between the data voltage at the start point of the blank period and the data voltage at the start point of the sensing period into n number of data voltage change sizes; and control the data voltage to gradually change during at least one time period among the n number of time periods in a period between the start point of the blank period and the start point of the sensing period.

10. The display device according to claim 9, wherein the n number of time periods is determined by the number of a divided data enable signal applied between the start point of the blank period and the start point of the sensing period.

11. A method of driving a display device including a display panel comprised of a plurality of data lines and a plurality of gate lines, a plurality of subpixels aligned in intersected areas of the data lines and the gate lines to light organic light-emitting diodes via driving transistors, and a plurality of reference voltage lines, a data driver circuit driving the plurality of data lines, a gate driver circuit driving the plurality of gate lines, and a timing controller comprising a memory storing a data voltage-for-sensing to sense a characteristic of a circuit element, and controlling signals applied to the gate driver circuit and the data driver circuit, the method comprising:

applying a data voltage to be gradually changed according to a rising slope from a start point of a blank period to a start point of a sensing period by using a data voltage-for-driving image applied to an emission period, as an initial level, wherein the rising slope of the data voltage is configured to be calculated using a voltage difference between the data voltage at the start point of the blank period and the data voltage at the start point of the sensing period, and a time difference between the start point of the blank period and the start point of the sensing period.

12. The method according to claim 11, further comprising: A method of driving a display device including a display panel comprised of a plurality of data lines and a plurality of gate lines, a plurality of subpixels aligned in intersected areas of the data lines and the gate lines to light organic light-emitting diodes via driving transistors, and a plurality of reference voltage lines, a data driver circuit driving the plurality of data lines, a gate driver circuit driving the plurality of gate lines, and a timing controller comprising a memory storing a data voltage-for-sensing to sense a characteristic of a circuit element, and controlling signals applied to the gate driver circuit and the data driver circuit, the method comprising:

applying a data voltage to be gradually changed according to a rising slope from a start point of a blank period to a start point of a sensing period by using a data voltage-for-driving image applied to an emission period, as an initial level;

calculating a voltage difference between the data voltage-for-driving image applied to the display panel at the start point of the blank period and the data voltage-for-sensing to be applied to the display panel at the start point of the sensing period;

calculating a time difference between the start point of the blank period and the start point of the sensing period; and calculating the rising slope of the data voltage by dividing the voltage difference with the time difference.

13. The method according to claim 12, wherein the applying the data voltage to be gradually changed includes:

dividing the time difference between the start point of the blank period and the start point of the sensing period into n number of time periods;

dividing the voltage difference between the data voltage at the start point of the blank period and the data voltage at the start point of the sensing period into n number of data voltage change sizes; and controlling the data voltage to be gradually changed during at least one time period among the n number of time periods in a period between the start point of the blank period and the start point of the sensing period.

14. The method according to claim 13, wherein the n number of time periods is determined by the number of a divided data enable signal applied between the start point of the blank period and the start point of the sensing period.

15. The method according to claim 13, wherein, if a value obtained by dividing a voltage difference between the data voltage at the start point of the blank period and the data voltage at the start point of the sensing period with the n number of time periods is a multiple of a resolution of the data voltage, the timing controller controls the data voltage to be changed by a constant size during the n number of time periods in a period between the start point of the blank period and the start point of the sensing period.

16. The method according to claim 13, wherein, if a value obtained by dividing a voltage difference between the data voltage at the start point of the blank period and the data voltage at the start point of the sensing period with the n number of time periods is not a multiple of a resolution of the data voltage, the timing controller controls the data voltage to be changed by an asymmetrical size during one or more time periods among the n number of time periods in a period between the start point of the blank period and the start point of the sensing period.

17. The method according to claim 13, wherein, if a voltage difference between the data voltage at the start point of the blank period and the data voltage at the start point of the sensing period is equal to or smaller than a resolution of the data voltage, the timing controller controls the data voltage to be changed by a size corresponding to the voltage difference between the data voltage at the start point of the blank period and the data voltage at the start point of the sensing period at the start point of the blank period or the start point of the sensing period.

18. A method of driving a display device, the method comprising:

calculating a voltage difference between a data voltage-for-driving image applied to a display panel at a start point of a blank period and a data voltage-for-sensing to be applied to the display panel at a start point of a sensing period;

calculating a time difference between the start point of the blank period and the start point of the sensing period; and calculating a rising slope of a data voltage by dividing the voltage difference with the time difference, wherein the data voltage-for-driving image is a positive voltage.

19. The method according to claim 18, further comprising controlling the data voltage to be gradually changed based on the rising slope from the start point of the blank period to the start point of the sensing period.

* * * * *